US005970631A

United States Patent [19]

Inman

[11] Patent Number: 5,970,631

[45] Date of Patent: Oct. 26, 1999

[54] FOOTWEAR FOR GRINDING

[75] Inventor: David G. Inman, Fullerton, Calif.

[73] Assignee: Artemis Innovations Inc., Torrance, Calif.

[21] Appl. No.: 08/799,062

[22] Filed: Feb. 10, 1997

Related U.S. Application Data

[60] Provisional application No. 60/022,318, Jul. 23, 1996.

[51] Int. Cl.[6] ..... A43B 5/00; A43B 13/22; A43B 13/28

[52] U.S. Cl. ..... 36/115; 36/132; 36/73; 36/103; 36/136; 36/75 R

[58] Field of Search ..... 36/132, 115, 114, 36/107, 72 A, 73, 108, 25 R, 148, 149, 152, 103, 116, 133, 136, 7.1 R, 76 R, 76 C, 72 R, 72 B, 75 R, 75 A, 82

[56] References Cited

U.S. PATENT DOCUMENTS

| | | | |
|---|---|---|---|
| 234,030 | 11/1880 | Hadley et al. . | |
| 579,577 | 3/1897 | Hanscom | 36/72 A |
| 702,476 | 6/1902 | Price | 36/72 A |
| 875,560 | 12/1907 | Vaughn . | |
| 881,079 | 3/1908 | Jolitz . | |
| 892,152 | 6/1908 | Harman | 36/89 |
| 1,051,880 | 2/1913 | Glenn . | |
| 1,056,091 | 3/1913 | Dickson | 36/72 A |
| 1,189,329 | 7/1916 | Winagle . | |
| 1,428,232 | 9/1922 | Holmen . | |
| 1,592,692 | 7/1926 | Hackett | 36/72 A |
| 1,636,909 | 7/1927 | Haney | 36/73 |
| 1,984,989 | 12/1934 | Reed . | |
| 2,114,461 | 4/1938 | Agosta et al. . | |
| 2,138,823 | 12/1938 | Werkman . | |
| 2,476,806 | 7/1949 | Brandt, Jr. | 36/72 A |
| 2,484,935 | 10/1949 | Rooy | 36/72 A |
| 2,490,469 | 12/1949 | Pittman . | |
| 2,897,609 | 8/1959 | Bodkin . | |
| 3,176,416 | 4/1965 | Seegert . | |
| 3,486,250 | 12/1969 | Purtle . | |
| 3,789,523 | 2/1974 | Rubin . | |
| 3,934,359 | 1/1976 | Fletcher . | |
| 4,316,334 | 2/1982 | Hunt | 36/91 |
| 4,496,025 | 1/1985 | Gattman | 182/121 |
| 4,691,453 | 9/1987 | Tifre . | |
| 4,843,741 | 7/1989 | Yung-Mao . | |
| 5,056,240 | 10/1991 | Sherill . | |
| 5,249,376 | 10/1993 | Capria . | |
| 5,319,866 | 6/1994 | Foley et al. | 36/91 |
| 5,388,350 | 2/1995 | Parker, Jr. . | |
| 5,398,970 | 3/1995 | Tucky | 36/115 |
| 5,410,821 | 5/1995 | Hilgendorf | 36/132 |
| 5,425,186 | 6/1995 | Hoyt | 36/97 |
| 5,632,104 | 5/1997 | Zohar | 36/25 R |
| 5,638,614 | 6/1997 | Hardy | 36/113 |
| 5,655,316 | 8/1997 | Huang . | |
| 5,682,685 | 11/1997 | Terlizzi . | |
| 5,716,723 | 2/1998 | Van Cleef et al. | 36/25 R |

FOREIGN PATENT DOCUMENTS

| | | | |
|---|---|---|---|
| 1138194 | 12/1982 | Canada | 36/115 |
| 1239017 | 7/1988 | Canada | 36/115 |
| 1194886 | 4/1959 | France . | |
| 117176 | 7/1918 | United Kingdom . | |
| 150512 | 9/1920 | United Kingdom . | |
| 216903 | 1/1925 | United Kingdom . | |
| PCT/US97/11652 | 10/1997 | WIPO . | |

*Primary Examiner*—Paul T. Sewell
*Assistant Examiner*—Anthony Stashick
*Attorney, Agent, or Firm*—Fulwider Patton Lee & Utecht, LLP

[57] ABSTRACT

Articles of footwear incorporating one or more sliding elements are described. Such articles include shoes, sandals, boots, and appliances for attachment to any or all of the foregoing. In addition to serving the traditional functions of footwear lacking such sliding elements, such footwear can be used for recreational "grinding," or sliding across hard surfaces having edges, corners, etc.

28 Claims, 23 Drawing Sheets

FIG. 6
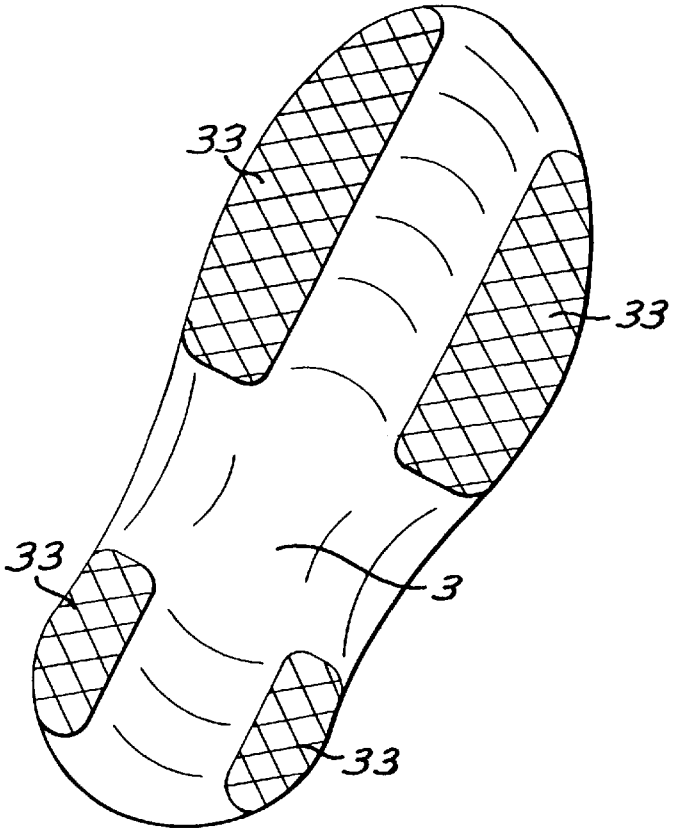
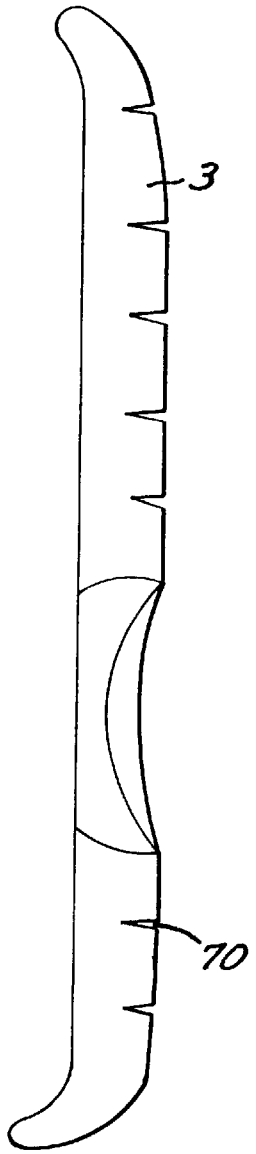
FIG. 6A

FOOTWEAR FOR GRINDING

CROSS REFERENCE TO RELATED APPLICATION

This application claims priority to provisional patent application U.S. Ser. No. 60/022,318, filed Jul. 22, 1996, which is hereby incorporated by reference.

FIELD OF THE INVENTION

The invention relates to articles of footwear in general, and in particular to shoes and the like which, in addition to being useful for walking, running, etc., facilitate "grinding" and similar activities.

BACKGROUND OF THE INVENTION

Articles of footwear, e.g., shoes, boots, and sandals, have long been available. In recent times, numerous specialized types of footwear have been made available for different applications, e.g., running shoes for running and basketball shoes for basketball. Even within these areas, more specialized footwear is available. For example, long distance running shoes combine light weight and shock absorption with other features important to long distance runners, while track "spikes" provide extremely light weight and proper foot support with a spiked sole for optimal traction on track and field surfaces. Likewise, basketball shoes come in many varieties, and include those having low, mid, and high tops for differing amounts of ankle support.

In addition, other types of footwear, such as roller skates, have been developed. Recently, in-line roller skates have gained popularity and are being used for many purposes, ranging from recreational use to fitness training. An exciting and demanding aspect of recreational skating, particularly among adolescents and young adults, is so-called "aggressive" or "street-style" skating. Such skating is best characterized by acrobatic skating stunts and maneuvers, some of which are referred to as "grinding," or sliding across a surface (as opposed to rolling or skating) by engaging a portion of one or both in-line skates, usually an underside portion of a skate frame between two adjacent wheels, or alternatively, a portion of an exposed area of the sole of the skate boot, with a feature on the skating surface, such as an edge or ridge.

However, at present, in order to "grind," a pair of in-line roller skates is required, and thus the opportunities to engage in this activity are limited to those instances when one is wearing or readily has access to such skates.

The present invention overcomes this and other limitations by providing an article of footwear, including but not limited to a shoe, sandal, boot, or appliance for attachment to the any of the foregoing, or, alternatively, directly to a foot, which incorporates one or more features to allow such articles to be useful for grinding. Such articles of footwear preferably also serve the traditional functions for which they were previously used, i.e., walking, running, working, etc. As a result of this invention, those possessing such articles of footwear will have greater opportunity and freedom to grind when and where they desire.

SUMMARY OF THE INVENTION

One aspect of the invention concerns an article of footwear having a sole, the sole having a lower portion which contains at least one recess housing a sliding element. Preferably, the sliding element is housed such that no part thereof protrudes below the lower surface of the sole (i.e., the ground contact surface of the sole), or, put another way, the sliding element is housed such that no part of it makes contact with the ground during a normal gait cycle during walking, running, or similar activities. In one embodiment, the article of footwear has one recess for housing a sliding element, wherein the recess substantially spans from the inside edge of the sole to the outside edge of the sole in the arch region of the sole. In an alternative embodiment, the recess housing the sliding element extends longitudinally from a forefoot region of the sole to a heel region of the sole, preferably from the toe end of the forefoot region to the rearward most part of the heel region.

Other embodiments relate to articles of footwear which having one or more sliding elements attached to a medial edge or lateral edge of the sole. In certain embodiments, the sliding element(s) of such articles of footwear are contiguous, and span from a forefoot region of the medial edge around the toe region to the forefoot, arch, or heel region of the lateral edge. Similarly, sliding elements may be attached to the medial and lateral edges in the heel region. A sliding element attached to the medial or lateral side generally does not protrude below the corresponding ground contact surface of the sole. Indeed, it is preferable that such elements stop somewhat short of the corresponding ground contact surface.

In preferred embodiments of this aspect of the invention, articles of footwear comprise more than one of the foregoing embodiments. For instance, transverse and longitudinal sliding elements are attached to the same article of footwear, preferably in one or more recesses, and one may intersect the other and/or be composed of distinct elements or the same element. Yet other embodiments relate to combinations of one or more sliding elements housed in or otherwise attached to the ground contact surface of the sole with one or more sliding elements attached to either or both edges of the sole. In a preferred embodiment, an article of footwear comprises a transverse sliding element substantially spanning from the inside edge of the sole to the outside edge of the sole in the arch region and a longitudinal sliding element in the forefoot and heel regions (which are preferably contiguous, substantially span from the toe end to the rearward most end of the sole, and intersect the transverse sliding element). Another preferred embodiment combines that of the foregoing sentence with sliding elements attached to the medial and/or lateral edges of the sole in the forefoot and heel regions. In yet other preferred embodiments, sliding elements extend diagonally from the forefoot to the heel region, and may or may not be contiguous, and may or may not intersect transverse sliding elements, if present.

Another aspect of the invention relates to the sliding element(s) housed in or attached to the sole or its edges. In one embodiment, the sliding element is a single component. In other embodiments, the sliding element is composed of multiple sliding element components. In addition, the shape of the sliding element or its components can vary, as can the materials used to produce the sliding element or its components.

Another aspect of the invention relates to the manner in which the sliding element(s) is/are attached or retained in its/their corresponding recess(es) or other attachment points in or to the sole. In one embodiment, the sliding element (or its components) is chemically bonded to the sole. In another embodiment, the sliding element(s) are affixed to the sole via one or more mechanical retainers. In yet other embodiments, some sliding element components are chemically bonded to the sole, while others are mechanically retained. In yet another embodiment, the mechanical retainer may be one that facilitates "quick release" of the sliding element (or component) retained thereby, and may also serve to prevent separation of sliding element(s) from other components or portions of the sole.

Still another aspect of the invention relates to the type of the article of footwear. One embodiment relates to shoes which contain one or more sliding elements. Other embodiments relate to sandals and boots which have one or more sliding elements. Alternatively, appliances containing one or more sliding elements which can be attached to any of the foregoing, or to an unshod foot, in a manner properly orienting the appliance for grinding, can be produced. Additionally, other types of footwear can be similarly adapted, whether during their construction or thereafter by attachment of an appropriate appliance.

An additional aspect of the invention concerns a sole of an article of footwear, the lower surface of which comprises one or more portions having a high coefficient of friction and one or more portions having a low coefficient of friction. Preferably, the portion(s) having a low coefficient of friction does not reduce contact of the portion(s) having a high coefficient of friction with a planar walking surface during normal use, i.e., walking or running.

These and other aspects and embodiments of the invention will become evident upon reference to the attached figures and detailed description below.

BRIEF DESCRIPTION OF THE FIGURES

FIG. 6 is similar to FIG. 4A showing arcuately shaped lateral and longitudinal sliding elements and further showing laterally projecting grooves;

FIG. 6A is a lateral side view, in enlarged scale, of the sole of the grinding shoe shown in FIG. 6;

Attached FIGS. 1–25A show a shoe designated generally by reference number 1, a sole designated generally by reference number 2, a sliding element designated generally by reference number 3, and the ground contact surface (hatched regions) of the sole designated generally by reference number 33. While these Figures depict a shoe for the right foot, the principles of the invention are equally applicable for shoes to be worn on the left foot, and for other types of articles of footwear, as those in the art will appreciate.

Numerous advantages and aspects of the invention will be apparent to those skilled in the art upon consideration of the following detailed description which generally provides illustrations of the invention in its presently preferred embodiments. It is understood that the invention can be adapted for use with other types of articles of footwear, e.g., sandals, boots, and other appliances for attachment directly to the foot, or to another article of footwear which is or will be attached to a foot of a wearer.

DETAILED DESCRIPTION OF THE INVENTION

The present invention relates to an article of footwear which incorporates one or more features (each a "sliding element" or "grind plate") which enable the article of footwear to be used for "grinding," in addition to serving the usual functions of comparable articles of footwear lacking such features. Typical surfaces on which "grinding" is practiced (herein, a "grinding surface") include, without limitation, handrails (preferably made of tubular metal) and the edges of curbs, stairs, etc., although almost any hard surface with an exposed straight or curved edge, ridge, or other similar grinding surface can be used. Various representative embodiments of the invention are described below.

In the present invention, the sliding element(s) is(are) attached to a portion of the article of footwear which can be brought into contact with a grinding surface by the wearer thereof in order to perform "grinding" maneuvers, tricks, and stunts. In most instances, the sliding element is therefor attached to or housed in the sole of the article of footwear. As used herein, the sole of an article of footwear is that portion which comes into contact with the ground under normal walking or running conditions. That part of the lower portion of the sole which comes into contact with the ground under normal walking or running conditions is referred to herein as the "ground contact surface."

Figure 1:
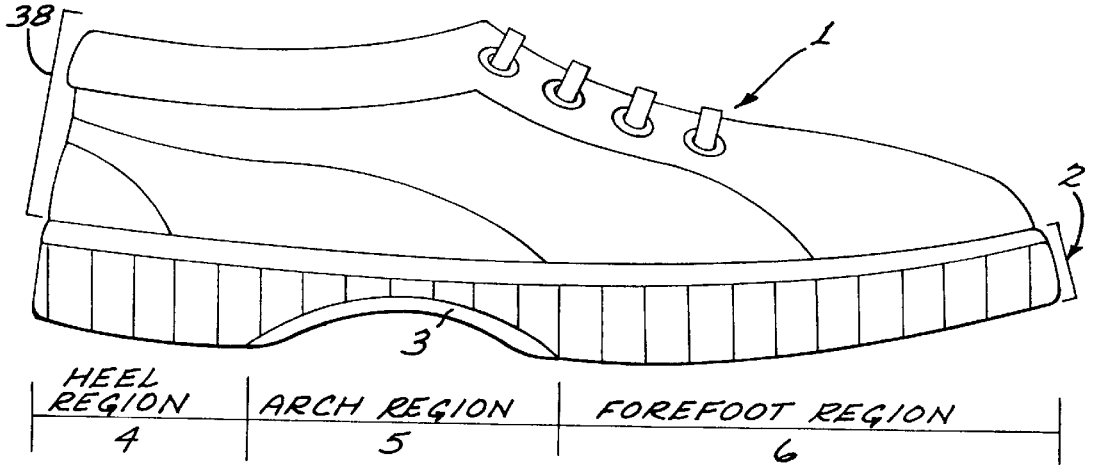
FIG. 1 is a lateral side view of a grinding shoe incorporating the present invention.

The sole serves three primary purposes, namely to cushion, protect, and support the foot of the wearer, and as shown in FIG. 1, can conceptually be divided into three areas, the heel region (4), the arch (or instep) region (5), and the forefoot region (6). As those in the art will appreciate, there is no necessarily distinguishable boundary between these regions. The heel region is intended to underlie the heel of the wearer, whereas the arch region underlies the arch of the foot and the forefoot region underlies the wearer's forefoot, which includes the ball of the foot and toes. The outside edge or portion of the sole is referred to as the lateral edge (7), and inside edge or portion of the sole is referred to as the medial edge (8). As with the sole generally, the lateral and medial edges may also be divided conceptually, here into heel, arch, and forefoot edges. In addition, at the tip or toe of the sole (the forward most area of the forefoot region), the lateral and medial edges converge. About the longitudinal axis of the sole (9; corresponding to that of the article of footwear), the forefoot edges of the medial and lateral edges converge at the toe point (10), while in the heel region (4), the lateral and medial edges converge at the heel point (11).

In the typical article of footwear, the sole is comprised of several components, two of which are the outsole and midsole, each of which typically extend the length of the article of footwear. See U.S. Pat. No. 5,319,866. The outsole is that portion which contacts the ground and underlies the midsole, or integrally surrounds at least a part of the midsole. The lower, ground contacting area of the underside of the outsole is referred to as the ground contact surface (33; hatched region in FIGS.), whereas as the upper side of the outsole is associated with, attached, or bonded to the lower surface of the midsole.

The outsole may be formed from one or more distinct components. For instance, the heel region of the outsole may be manufactured as a separate component from the forefoot region of the outsole. Such may be the case when a transverse sliding element (12) substantially spanning from the lateral edge (7) to the medial edge (8) of the sole is employed in the practice of the invention. Alternatively, the outsole may be manufactured as a single component to include one or more recesses for housing a sliding element, or multiple sliding elements. Preferably, the outsole (and other sole components, for that matter) is manufactured by injection molding techniques well known in the art.

The outsole, or the sole in those instances where the sole does not contain a midsole, is generally made of an abrasion resistant material, such as rubber or another elastomeric polymer, which also provides a sufficient amount of traction, or adhesive friction (both static and kinetic) for the intended application (separate and apart grinding applications) of the particular article of footwear, e.g., for running, cross training, basketball, and tennis. Such materials have coefficients of friction sufficient to provide the appropriate amount of traction in a given application.

This is in contrast to the sliding elements of the invention, which are made of one or more different materials, preferably hard, smooth materials which exhibit much lower coefficients of friction or levels of adhesive friction, whether static or kinetic, than the material comprising at least the ground contact surface of the sole. Thus, in contrast to conventional articles of footwear, portions of those according to the invention which are capable of contacting grinding surfaces provide for less, not more, traction or adhesive friction than other parts of the article in order to facilitate grinding when so desired. In preferred embodiments, a new, unused sliding element of the invention will have a level of adhesive friction at least 2, 3, 4, 5, 10, 15, 20, 25, 50, 100, or more fold less than that for the outsole material when compared on standard concrete as is found in municipal curbs and stairs in Los Angeles, Calif., or as described in Standard Specifications for Public Works Construction (Building News Inc., Los Angeles, Calif., 1985 ed.) and *Standard Specifications,* State of California, Department of Transportation, July 1995 ed. Alternatively, differences between coefficients of friction with respect to sole material and a sliding element can be measured on unpainted steel hand rails found on outdoor municipal stairs.

Certain preferred embodiments of the invention relate to soles which contain one or more recesses for housing one or more sliding elements or the components thereof, which are preferably fitted or attached to the sole in an integral fashion, thereby not only enhancing the appearance of the finished article of footwear, but also its function, performance, and utility. The shape and position of any such recess will depend on a variety of factors, including, without limitation, the size, type, and intended application of the article of footwear, and the size, shape, and intended location of the particular sliding element or components thereof. Recesses for housing and attaching sliding elements preferably are incorporated into the a portion of an article of footwear, e.g., the sole, during the manufacture of such portion, particularly during the casting or molding phase of the sole. It is understood that while recesses for housing sliding elements are preferred, the present invention also contemplates attaching the same to the article of footwear absent such a recess, or, alternately, casting or molding the sole or outsole) about one or more sliding elements pre-positioned in the mold therefor.

In some embodiments of the invention, particularly those relating to athletic shoes, the sole of the article of footwear will also comprise a midsole, preferably integrally combined with the outsole. Midsoles are primarily responsible for cushioning, and typically are comprised of materials such as polyurethane and ethyl acetate foams, and more recently developed materials such as HYTREL™ (E. I. DuPont de Nemours & Co., Inc.). A sockliner designed to provide additional cushioning and support may be disposed above the midsole. It is understood, however, that the presence of distinct midsole, outsole, and other sole components is not essential to the practice of the present invention.

In addition to a sole, articles of footwear according to the invention also include a portion which enables the sole to be attached to a wearer's foot, or, in the case of an appliance, to another article of footwear. The attachment portion employed varies depending upon the type of footwear. With respect to embodiments wherein the article of footwear is a shoe or boot, the attachment portion typically comprises an upper. An upper is preferably formed from leather, canvas, cloth, synthetic material, or a combination of any of the foregoing, configured to receive a wearer's foot. As with the sole, an upper may be conceptually divided into three parts, namely a heel part, an arch part, and forefoot part, with each part being disposed proximate to the corresponding anatomical part of a wearer's foot when the foot is inserted therein. The top surface of the sole is aligned with and attached to the bottom surface of the upper, or alternatively, the bottom edges of the sides of the upper are attached to a corresponding area on the sole, typically to the corresponding edge of the sole on the upper surface thereof.

In embodiments of the invention which relate to sandals, the sole is fastened or bound to the foot by thongs or straps, preferably including an ankle strap to better secure the sandal to the wearer's foot.

Figure 15:
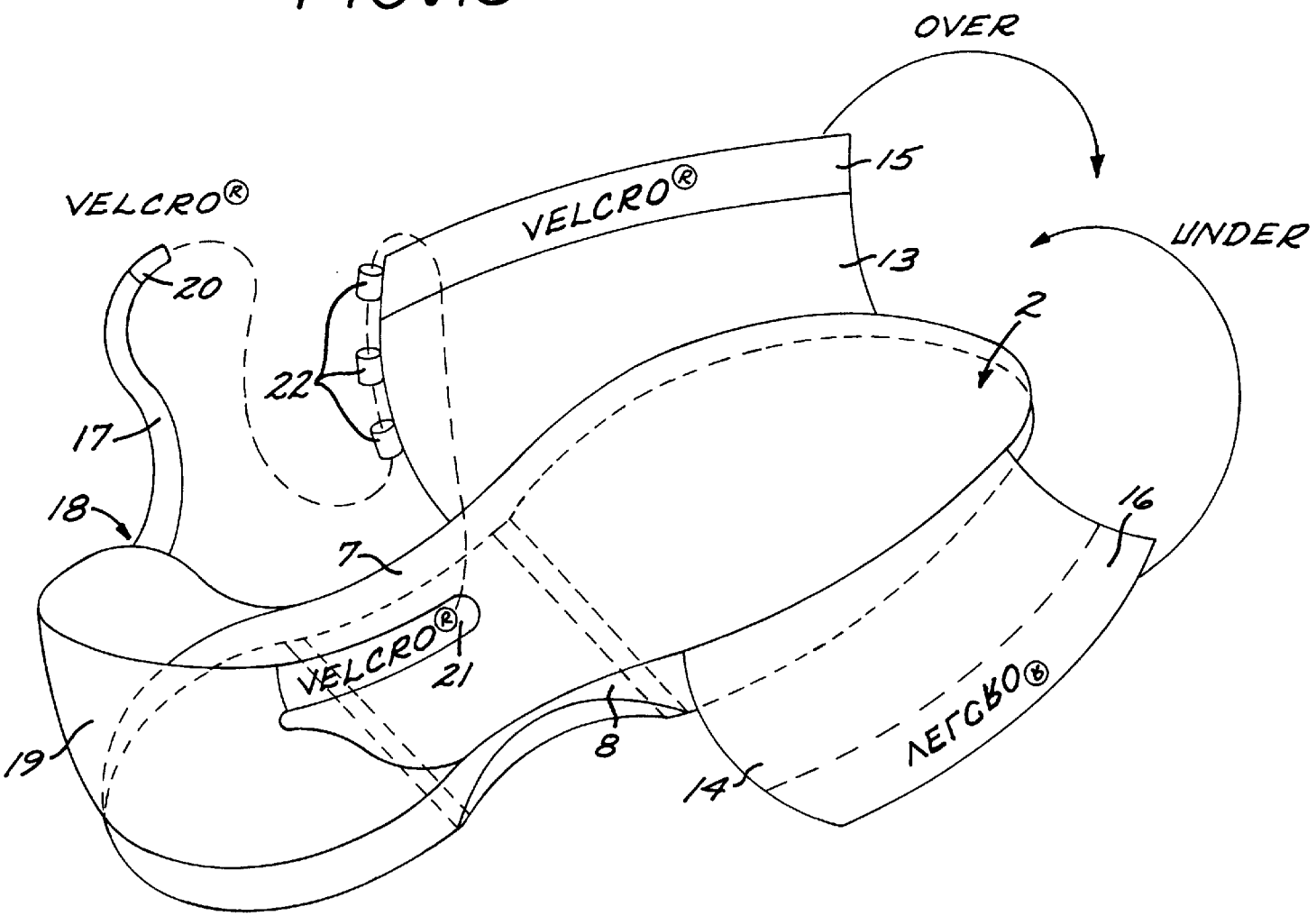
FIG. 15 depicts a rear perspective view of an alternative embodiment of the grinding shoe of the present invention.
Figure 16:
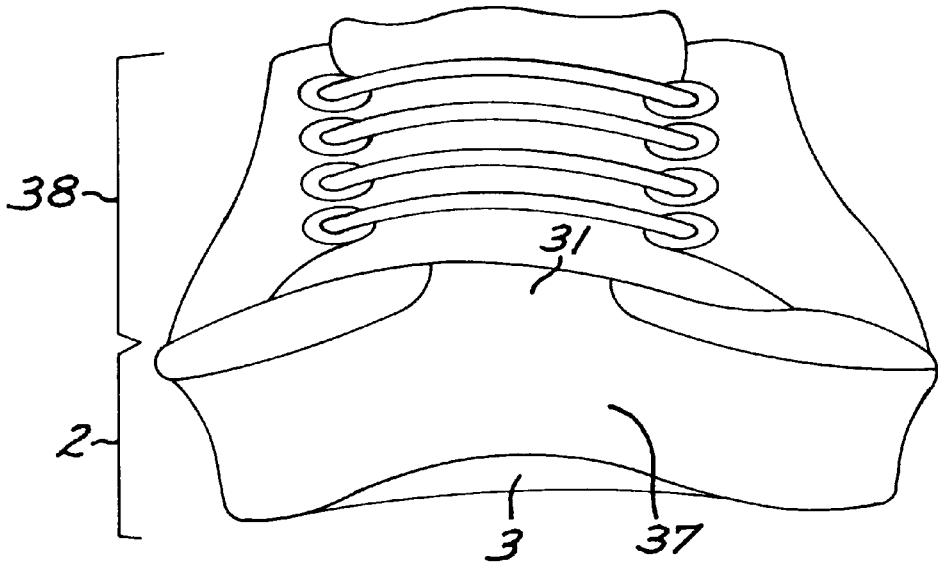
FIG. 16 is a front view of a grinding shoe of the present invention illustrating a longitudinal sliding element in the forefoot region.
Figure 16A:
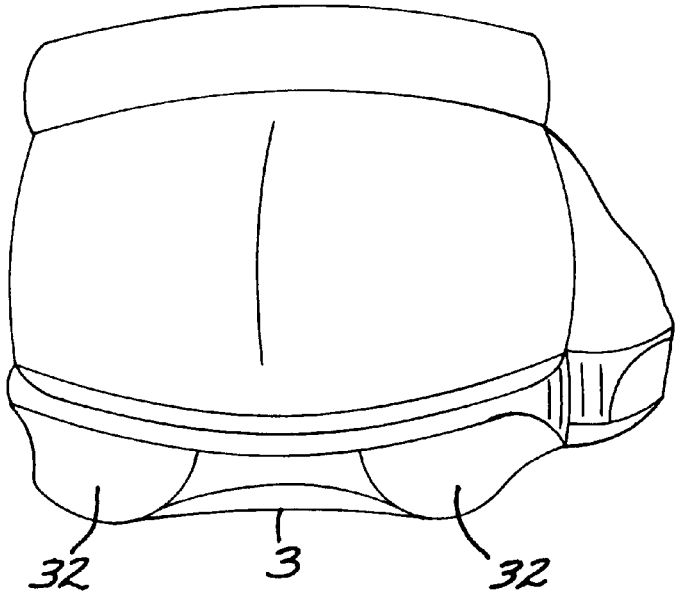
FIG. 16A is a rear view of the shoe shown in FIG. 16 illustrating the incorporation a sliding elements in the heel region.
Figure 17:
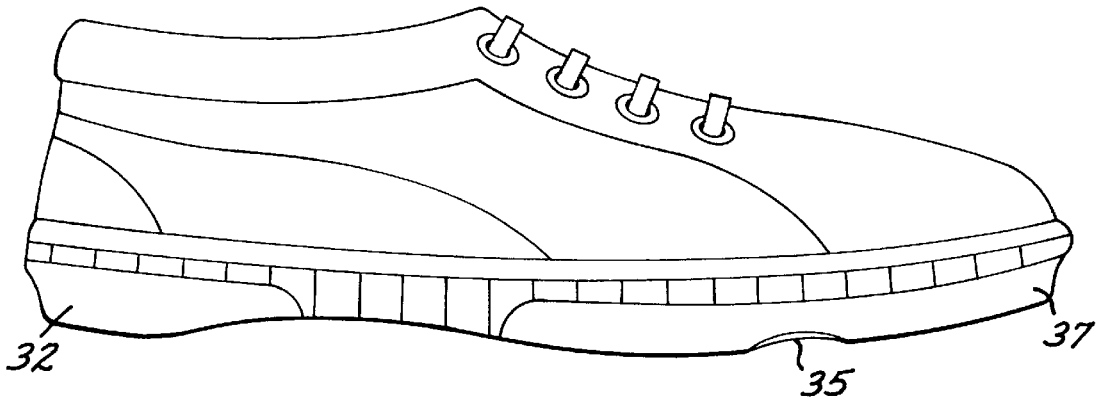
FIG. 17 is a lateral side view of another embodiment of the grinding shoe of the present invention showing a transverse sliding element spanning from the lateral edge to the medial edge under the ball of the foot, a logitudinal sliding element spanning form toe to heel regions and additional sliding elements disposed on the medial and lateral edges of the sole.
Figure 17A:
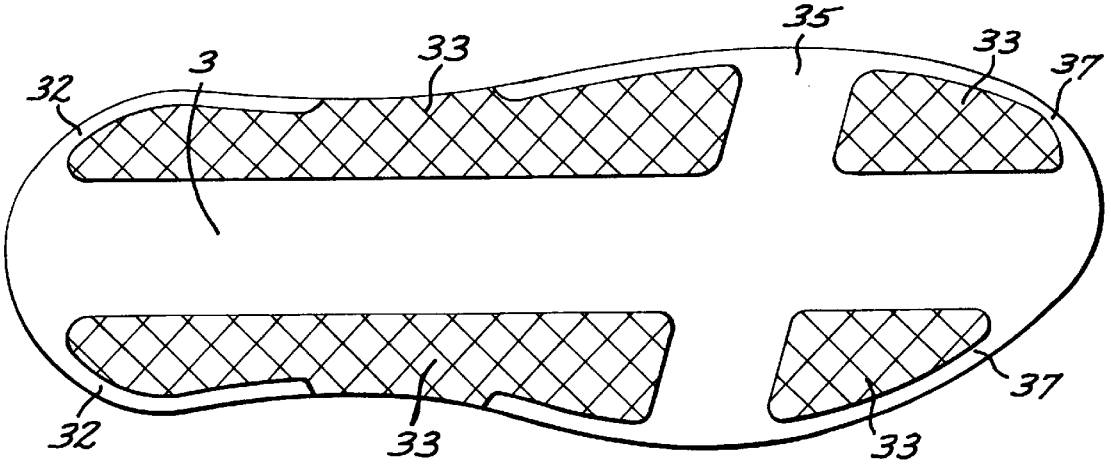
FIG. 17A is a bottom view of the grinding shoe in FIG. 17.

With respect to an article of footwear which is an appliance for fastening a sole containing one or more sliding elements to a another article of footwear, hereinafter an "appliance," the sole thereof is attached to an upper adapted for accepting another article of footwear. Alternatively, the sole of such an appliance may be fastened to an article of footwear using thongs or straps, preferably including an ankle strap. One embodiment of such an appliance is depicted in FIG. 15, wherein a flap of material is secured to either side of the forefoot region of the sole (2), with the lateral flap (13) being proximate to the lateral edge (7) and the medial flap (14) being proximate to the medial edge (8). The flaps contain one or more elements, such as buckles, laces, or other fasteners (here complementary VELCRO™ strips 15 and 16) which enable the flaps to be fastened or bound together after association with an article of footwear (or foot for that matter) in order to secure at least the forefoot region of the sole to the article of footwear (or foot) . To further secure the appliance, an element securely fastening the heel region of the sole to the corresponding area of the other article of footwear (or foot) is preferably included. In one embodiment, such an element comprises a heel strap (17) attached at its proximal end (18) to the upper, lateral portion of a heel element (19) attached to the sole of appliance. The heel is secured by associating the heel strap with the flaps (13 and 14) and fastening the distal end (20) of the heel strap with a complementary attachment feature (21) on the lateral portion of the heel element. One of many known ways of associating the heel strap with flaps 13 and 14 is through the use of one or more loops (22) attached to either or both flaps. Complementary attachment features between the distal end (21) of the ankle strap (17) and the heel include buckles, VELCRO™, etc. As those in the art will appreciate, the orientation of the ankle strap may be reversed, such that the proximal end of the ankle strap is attached to or a part of the lateral portion of the heel element.

To enable the articles of footwear described herein to be used for "grinding," one or more sliding elements (3) is/are incorporated therein. As used herein, a "sliding element" (also referred to as a "grinding element" or "grind plate") is a piece of material which facilitates sliding of an article of footwear housing such sliding element when a portion of such sliding element at least substantially forms the area of contact between the article of footwear and a grinding surface.

Materials useful in the manufacture of sliding elements according to the invention include plastics (preferably hard plastics) and other polymers, metals, ceramics, composite materials, wood, and combinations of any of the foregoing, although any material (or combination of materials) which facilitates sliding on a grinding surface when incorporated into an article of footwear can be used in the practice of the invention. Preferred plastics include polyvinyl chloride (PVC), plexiglass (e.g., LEXAN™ and perspex), high pressure laminates, polycarbonates (e.g., ENSICAR™), polysulfones (e.g., ENSIFONE™, polybutylene and polyethylene terepthalate, and nylons (e.g., VEKTON® and ENSILON™). Preferred metals include steel, aluminum, magnesium, and alloys of such metals. Composite materials include fibers such as carbon or glass fibers in a synthetic matrix, such as a resin, or in other matrices, such as those comprising various metals. See *Composite Materials Handbook,* M. Schwartz, 2nd Ed., McGraw-Hill, Inc., 1992. Preferred woods include hard woods, such as oak, walnut, and cocobolo.

Material(s) Used as a sliding element for use in connection with the present invention can be manufactured in a number of different ways, and will also depend on the type of material(s) used. However, processes which provide for mass production of sliding elements are preferred, and include, but are not limited to, well known techniques such as milling, machining, casting, extrusion, or injection molding, although, as those in the art will appreciate, a process suitable for one material may rot be well suited for another.

As will be appreciated by those in the art, a sliding element can be comprised of a single material, different compositions of the same material (e.g., a plastic sliding element wherein the polymer material has different amounts of cross-linking in different regions), or more than one material, for example, a plastic and metal combination. The particular composition of materials used in sliding elements will depend on many factors, including, among others, the type of sliding element concerned (e.g., single or multi-component), the location of the sliding element on the article of footwear, the degree of flexibility or deflection required or desired, and the intended application (for example, as an all purpose grind shoe or as an appliance intended only for grinding on metal hand rails). Accordingly, the particular composition of a sliding element is within the skill of those in the art. In addition, sliding element materials may be coated with one or more substances, e.g., TEFLON®, to enhance their grinding or sliding capability, preferably by decreasing the material's coefficient of friction, particularly its coefficient of dynamic friction.

Because the instant invention generally relates to articles of footwear which car serve dual purposes, i.e., grinding in addition to the traditional role of such footwear (e.g., running, cross training, basketball, tennis, etc.), the sliding elements or grind plates (3) according to the invention are preferably designed to minimize or eliminate interference with the traditional role of the article. In this regard, when necessary, sliding elements are engineered and designed to bend, flex, or deflect in a manner complementary to that part of the article of footwear to which the sliding element(s) is(are) attached. The amount and type of flexibility or deflection engineered into a particular grind plate is within the skill of those in the art and will depend on numerous factors, including the mounting location of sliding element, its, length, width, and thickness, the material(s) composition thereof, and how it is to be attached to the article of footwear. One such grind plate is depicted in FIGS. 6 and 6A, where the grind plate (3) comprises lateral grooves (70) to facilitate flexion.

Figure 18:
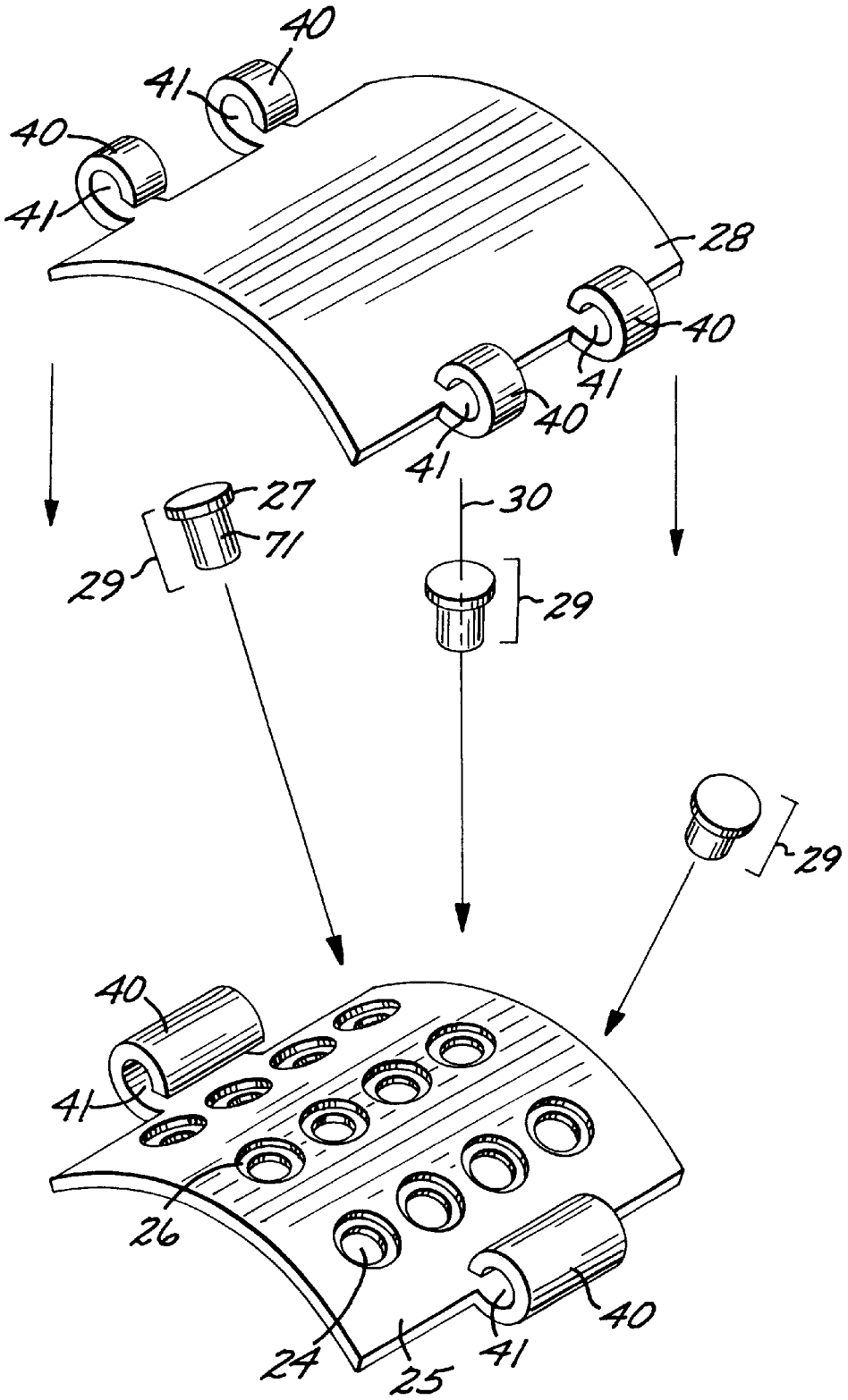
FIG. 18 is an exploded perspective view of an alternative embodiment of the plate of the present invention.

Sliding elements can also be comprised of multiple parts, each a "sliding element component" (29). One such embodiment is depicted in FIG. 18, where each of the several sliding element components (29) protrude through a bore (24) in a face plate (25), wherein in each bore (24) has a recessed component seat (26) upon which the head (27) of each sliding element component seats flush upon insertion into the face plate (25). After insertion of the sliding element components into the face plate, a backing plate (28) is preferably placed thereon. The backing plate serves to prevent the components (29) from being pushed up into the sole (or outsole) upon contact with a grinding surface under a load. While the heads (27) and shaft portions (71) of the sliding element components (29) depicted in FIG. 18 are cylindrical, numerous shapes, including rectangles, triangles, etc., can be employed. Similarly, combinations of shapes may be used. The size of each sliding element component may be uniform, or differ, either with respect to each component, from component to component, or both, depending upon its intended final location in the sliding element or article of footwear. As an example, some sliding element components in a multi-component sliding element may have a round head (27) and shaft portion (71) which extends through the bore (24) (thereby providing for potential rotation of the component in the bore), which shaft portion transitions to a shaft having a square cross section (when sectioned perpendicular to its longitudinal axis (30)) which tapers to a small flat, square ground contact surface. As those in the art will appreciate, many profiles of the ground contact surface of a sliding element are possible, and include hemispherical, flat, and convex shapes when new, although grinding activities will tend to abrade such surfaces, the rate of which depends on many factors, including the material(s) used to produce the component, the number of components in the sliding element, the total surface area, the grinding surfaces encountered, the weight of the wearer, and the use of one or more coatings to reduce the coefficient of friction on the sliding element and/or the grinding surface. Such coatings include TEFLON®, paint, wax, and soap, although many other such coatings may be used.

Additionally, the material(s) used to produce sliding element components may be the same or different. For instance, in a transverse, arcuate sliding element as is depicted in FIG. 18, those components (29) located in the middle of the three columns may be comprised of a harder material, or one having a lower coefficient of friction, than those on either side, thereby enabling more control of the article of footwear to which such sliding element is attached during a grinding maneuver.

Other embodiments of sliding elements include those which are physically segmented into two or more parts. One such embodiment is depicted in FIGS. 6 and 6A. Segmenting can enhance the ability of the sliding element to flex or deflect under loaded conditions. As with other sliding elements within the scope of the invention, segmented sliding elements can be produced from the same or different materials. When made from different materials, the various components are attached, preferably by chemical bonding. Here, as elsewhere, in the event of layering of materials within a given segment, or across the entire sliding element (or its components), different layers may be made of different material(s) which have different characteristics. In addition, different layers may have different colors, thereby providing for easv visual assessment of the wear pattern of a given sliding element (or component thereof).

Figure 2:
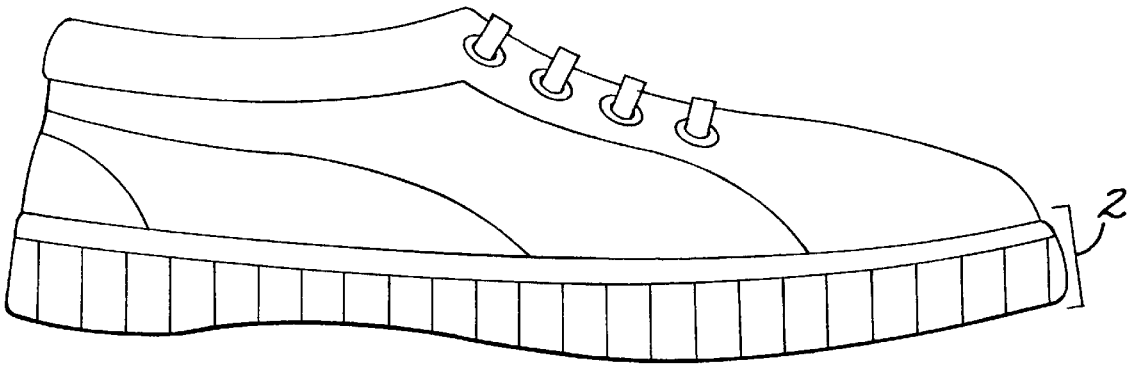
FIG. 2 is a lateral side view of a second embodiment of the grinding shoe of the present invention.
Figure 2A:
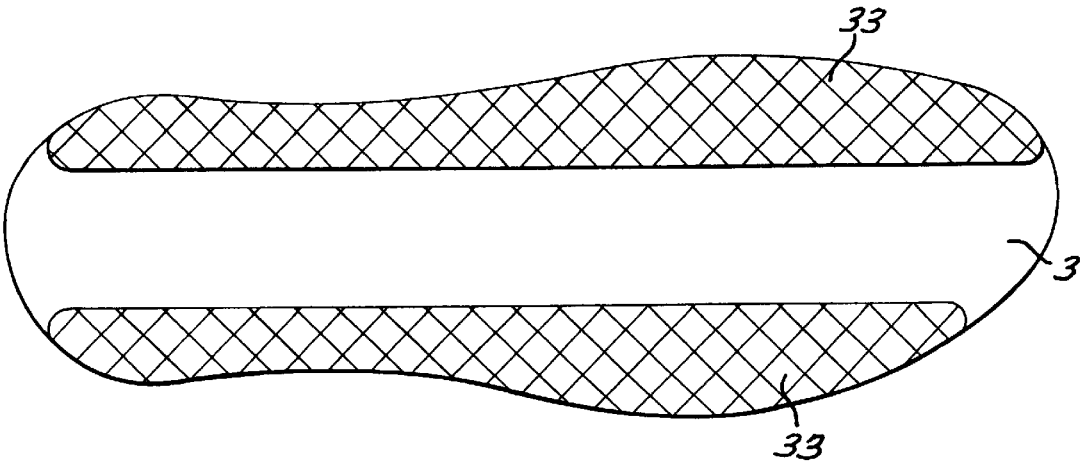
FIG. 2A is a bottom view of the grinding shoe shown in FIG. 2.
Figure 3:
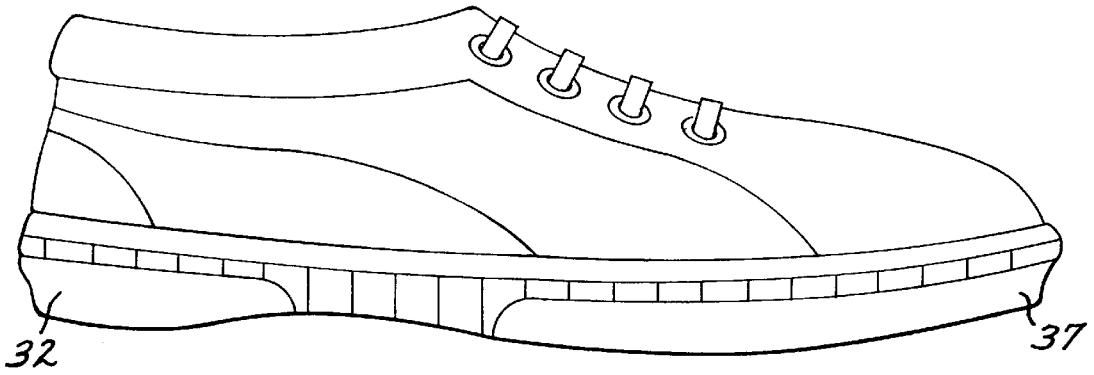
FIG. 3 is a lateral side view of a third embodiment of the grinding shoe of the present invention incorporating sliding elements integrally attached to forefoot and heel regions of the lateral and medial sides of the shoe.
Figure 3A:
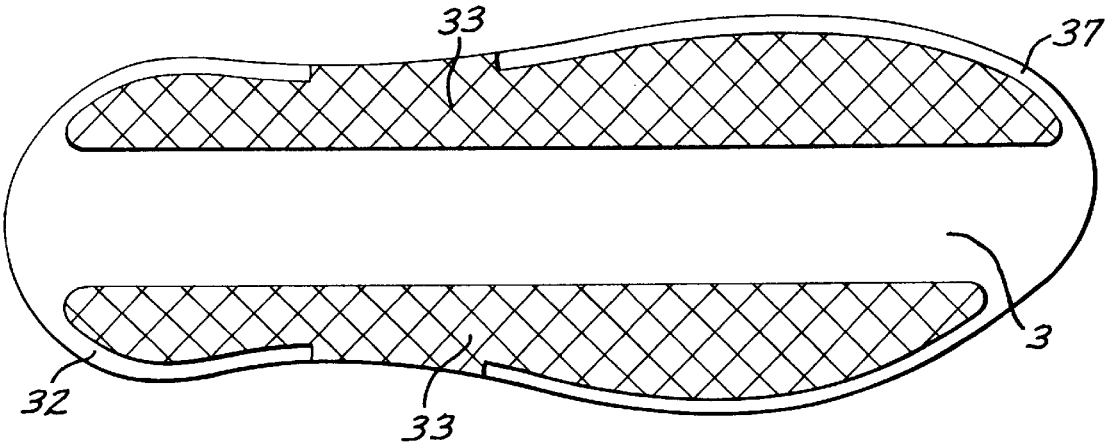
FIG. 3A is a bottom view of the grinding shoe shown in FIG. 3.
Figure 4:
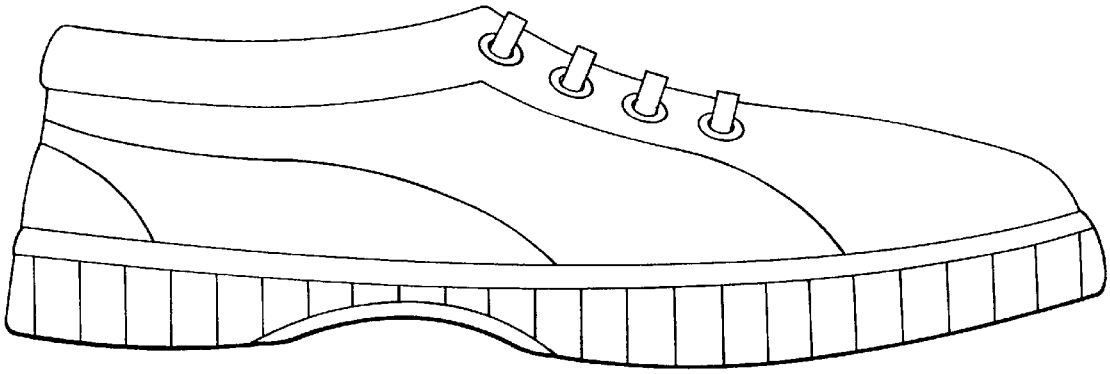
FIG. 4 is a lateral side view of a fourth embodiment of a grinding shoe of the present invention incorporating a transverse sliding element spanning from the lateral edge to the medial edge of the shoe in the arch region and a longitudinal grind plate spanning from the toe to the heel.
Figure 4A:
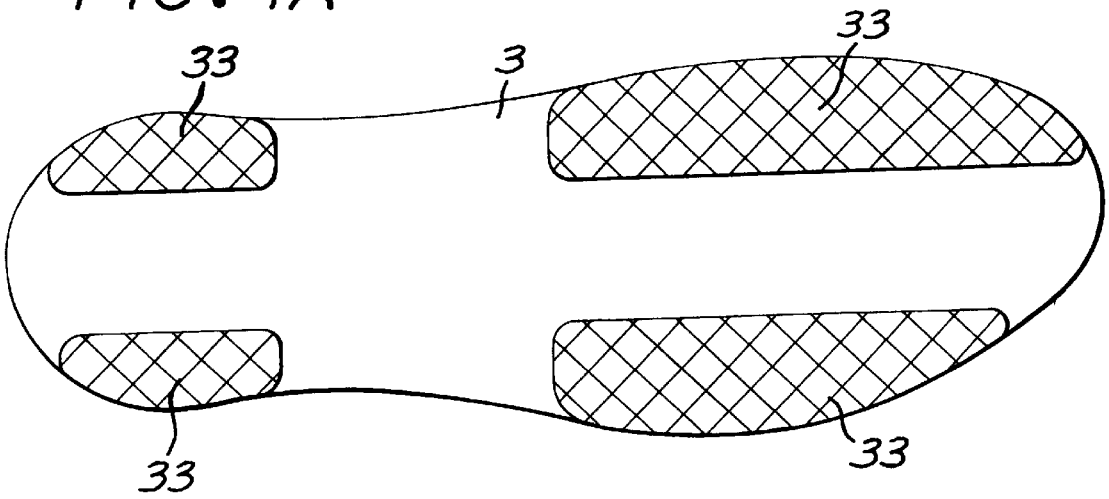
FIG. 4A is a bottom view of the grinding shoe shown in FIG. 4.
Figure 5:
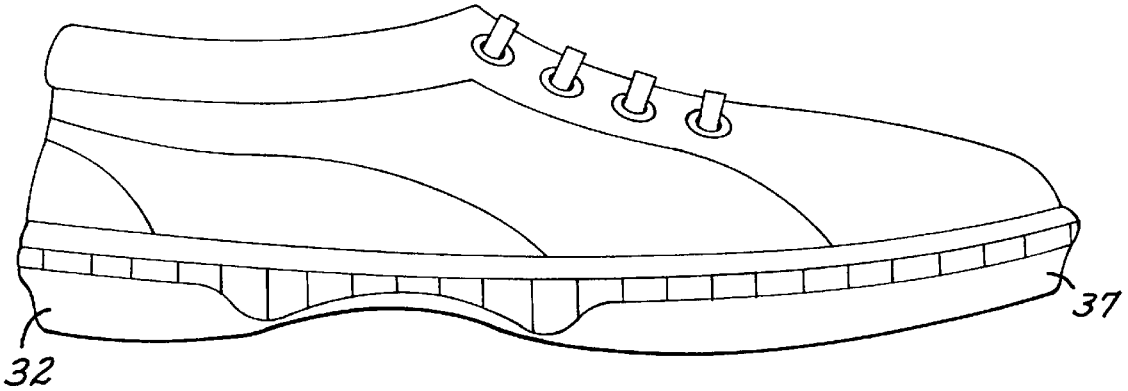
FIG. 5 is a lateral side view of a fifth embodiment of a grinding shoe of the present invention incorporating features depicted in FIGS. 1–4A.
Figure 5A:
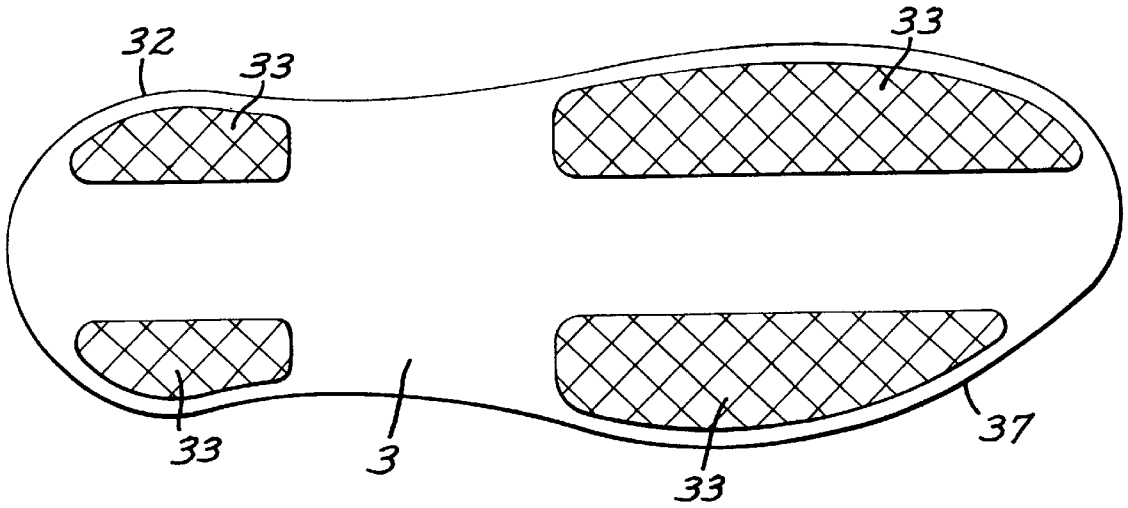
FIG. 5A is a bottom view of the grinding shoe shown in FIG. 5.

Sliding elements can be incorporated in numerous locations on an article of footwear, with housing within the sole (preferably in the outsole when present) being most preferred. It is understood, however, that one or more sliding elements may be mounted or attached to the upper of the article of footwear to protect the upper from wear or abrasion as can occur in certain grinding maneuvers enabled by the present invention. With respect to the sole, particularly preferred locations for housing a sliding element include the arch region (5), the forefoot region(6), the heel region(4), within the lateral edge (7) or the medial edge (8), the toe edge area (31) as shown in FIG. 2, and the heel cap (32) as shown in FIGS. 3, 3A, 5, 5A, 16A, 17, 17A. Articles of footwear containing a sliding element, or more than one such element, in one or more of these locations are also within the scope of the invention, and several such embodiments are later described.

When housed or otherwise attached to an article of footwear, particularly when the sliding element is positioned on the underside of the sole, it is preferred that the sliding element is positioned in its corresponding recess (or other attachment point, as the case may be) in such a way so to avoid contact with flat ground during normal walking or running activity, as shown in FIGS.1, 1A, 2, 2A, 4–7D, 13, 14, 17, 17A and 20. This can be accomplished by designing the recess and corresponding sliding element so as to avoid protrusion of the latter through an imaginary plane formed by the lowest points of the boundary of the former. By avoiding such protrusion, the sliding element does not interfere with contact between the ground contact surface and the article of footwear with the ground during non-grinding activities.

Figure 1A:
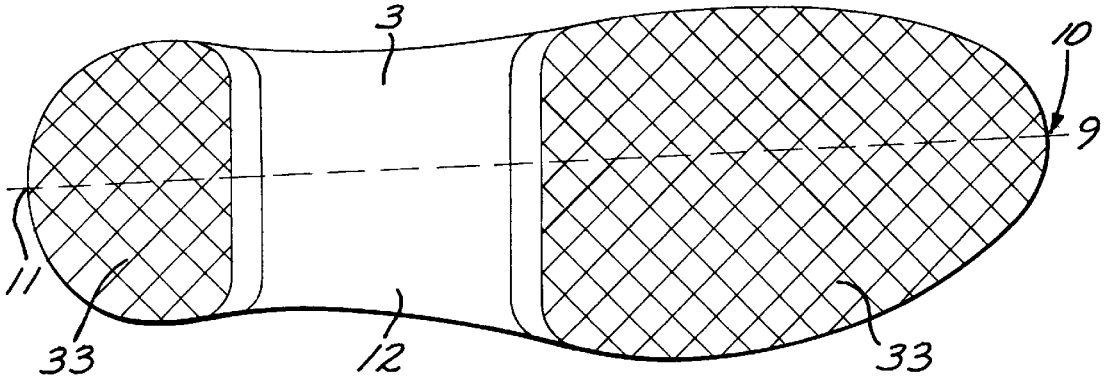
FIG. 1A is a bottom view of the grinding shoe shown in FIG. 1.

With respect to a sliding element housed in or otherwise attached to the underside of the arch region of the sole, an embodiment of which is depicted in FIGS. 1 and 1A, among others, it is preferred that such sliding element substantially span from the lateral edge (7) to the medial edge (8) of the arch region. However, other configurations are also within the invention's scope, and include those wherein the sliding element spans only from either the lateral or medial edge to the longitudinal axis (9) or less of the article of footwear, and wherein the sliding element spans only that area of the arch region proximate to edge in which it is housed or attached.

Figure 14:
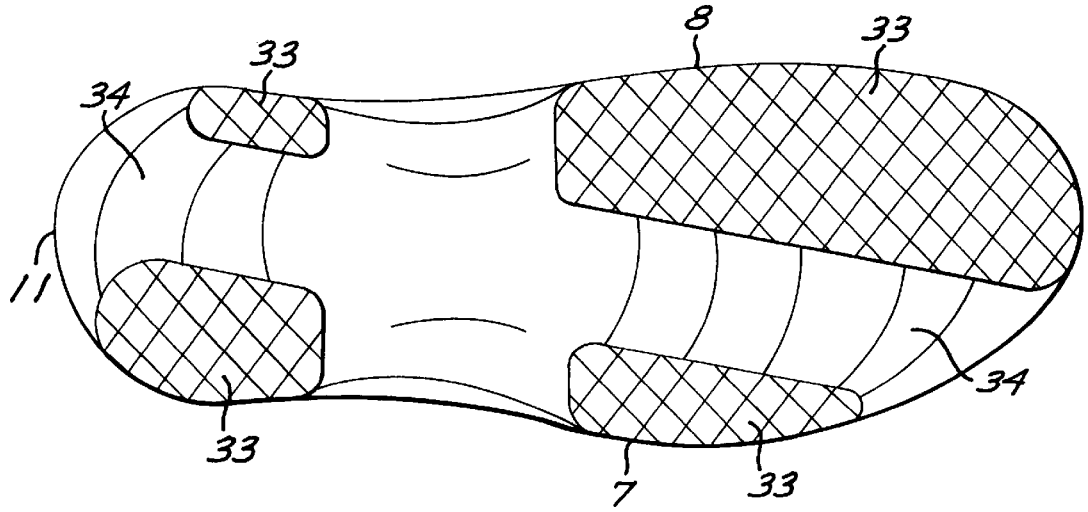
FIG. 14 is the same view as FIG. 13 depicting the longitudinal sliding element skewed in an alternative manner.

Another embodiment relates to a sliding element as described in the preceding paragraph combined, either separately or integrally, with a sliding element substantially spanning from the toe point (10) to the heel point (11). See FIGS. 2–5A. Such an article of footwear not only enables grinding perpendicular to a wearer's direction of travel, but also parallel thereto (when viewed in relation to the orientation of the foot and/or article of footwear). A variation of this embodiment includes two longitudinal sliding elements, neither of which make contact with the transverse sliding element, and need not span to the toe point or heel point. Many other configuration for intrasole-mounted sliding elements include those depicted in FIGS. 4–7D, 13, and 14, each of which show a longitudinal sliding element mounted diagonally and intersecting a transverse sliding element in the arch region. The longitudinal sliding element (34) in FIG. 13 extends from the toe region of the medial edge (8) the heel region of the lateral edge (7) and which wraps around to incorporate a portion of the heel region of medial edge (8) near the heel point (11), while FIG. 14 illustrates a similar configuration, the difference being that lateral edge (7) to the heel region of the medial edge (8) and which wraps around to incorporate a portion of the heel region of lateral edge (7) near the heel point (11).

In those instances when one sliding element makes contact with another, or a single sliding element incorporates portions which intersect, the corners and/or edges of such areas of intersection are preferably rounded or otherwise contoured so as to reduce the likelihood that the article of footwear may snag thereupon while grinding or sliding, and to facilitate transition from one maneuver to the next. See FIGS. 2–7D, 13, 14, 17A, and 20.

Another location to which a grind plate may be attached is to forefoot region under the ball of the foot (35). See FIGS. 17A and 20.

Figure 7:
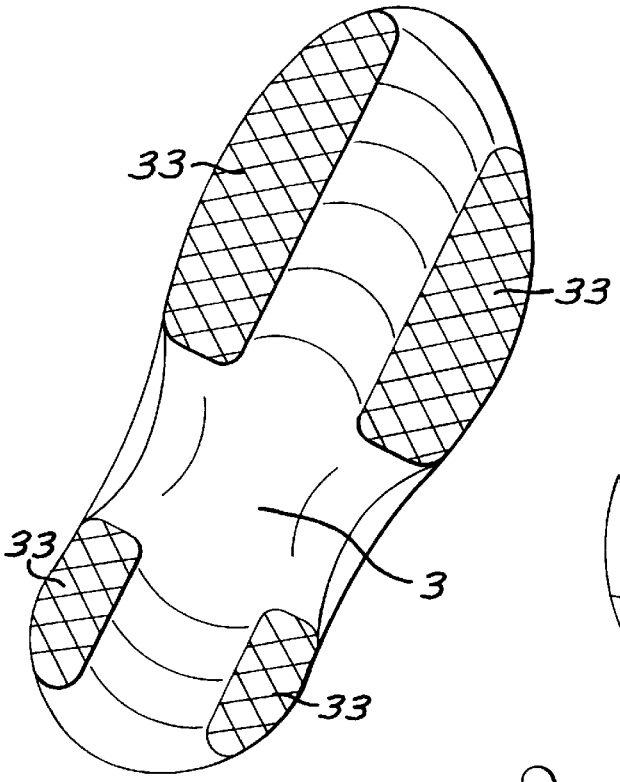
FIG. 7 is similar to FIG. 6.
Figure 7A:
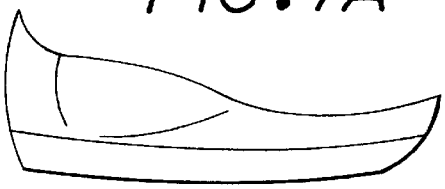
FIG. 7A is a transverse sectional view, in enlarged scale, of an alternative embodiment to that shown in FIG. 7.
Figure 7B:
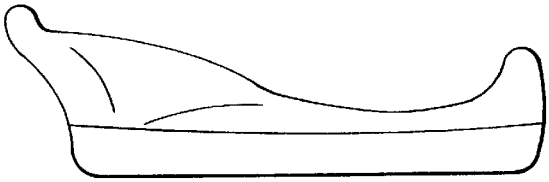
FIG. 7B is the same view as FIG. 7A, of another alternative embodiment to that shown in FIG. 7.
Figure 7C:
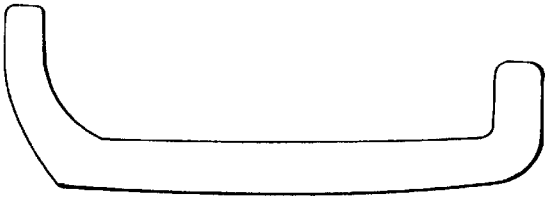
FIG. 7C is the same view as FIG. 7A, of an alternative embodiment to that shown in FIG. 7.
Figure 7D:
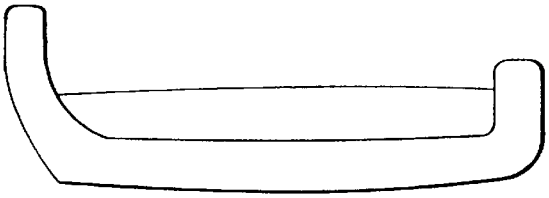
FIG. 7D is the same view as FIG. 7A, of another alternative embodiment to that shown in FIG. 7.
Figure 8:
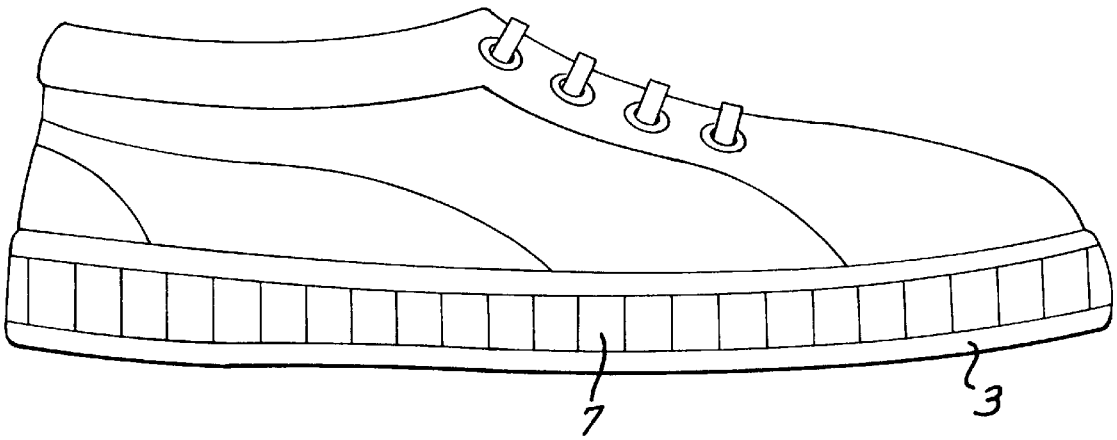
FIG. 8 is a lateral side view of another embodiment of a grinding shoe of the present invention incorporating a sliding element on the lateral portion of the sole.
Figure 8A:
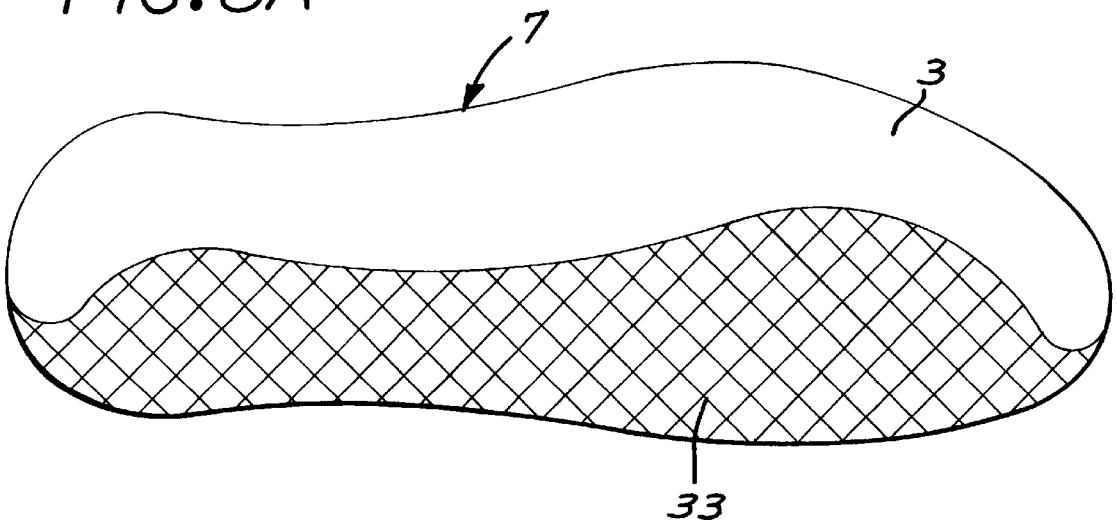
FIG. 8A is a bottom view of the grinding shoe shown in FIG. 8.
Figure 9:
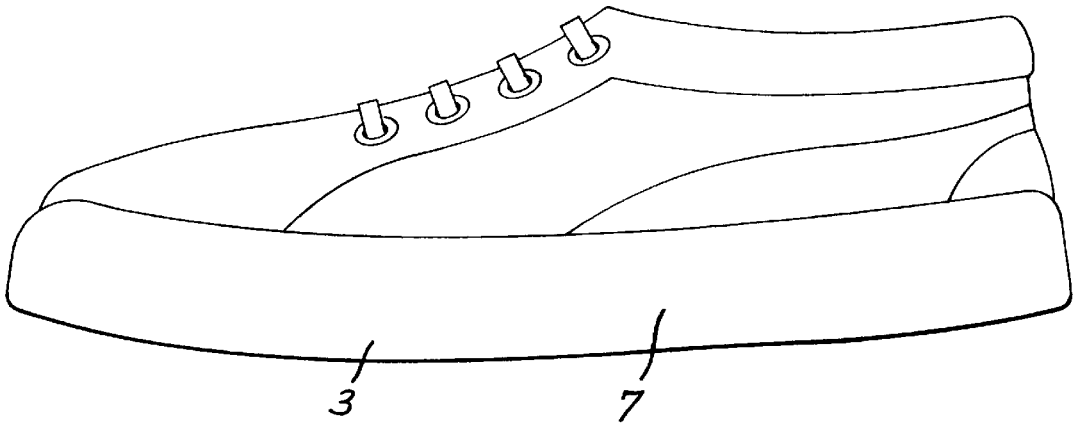
FIG. 9 is a lateral side view of a left grinding shoe of the present invention having a narrow longitudinal sliding element on the lateral portion of the sole which wraps up onto a portion of the lateral edge of the sole.
Figure 9A:
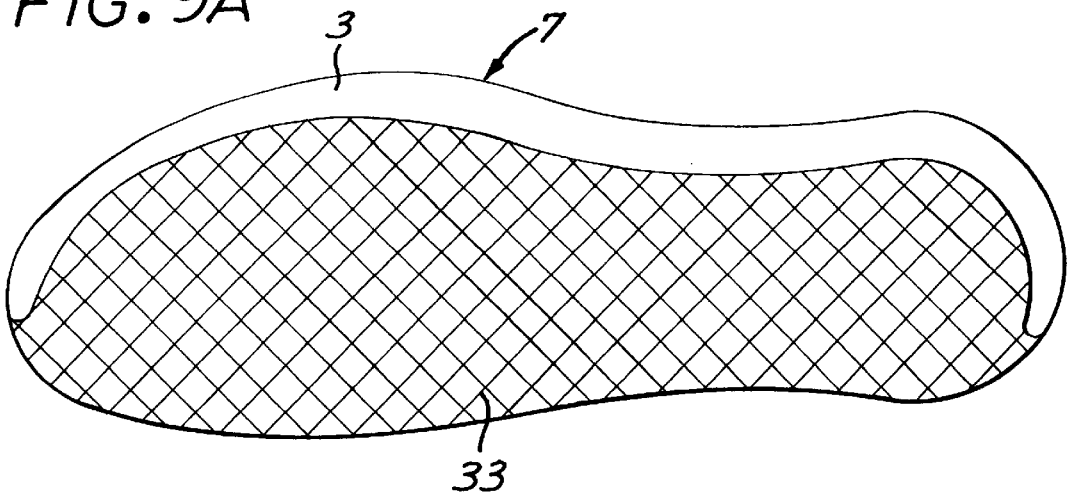
FIG. 9A is a bottom view of the grinding shoe as shown in FIG. 9.
Figure 10:
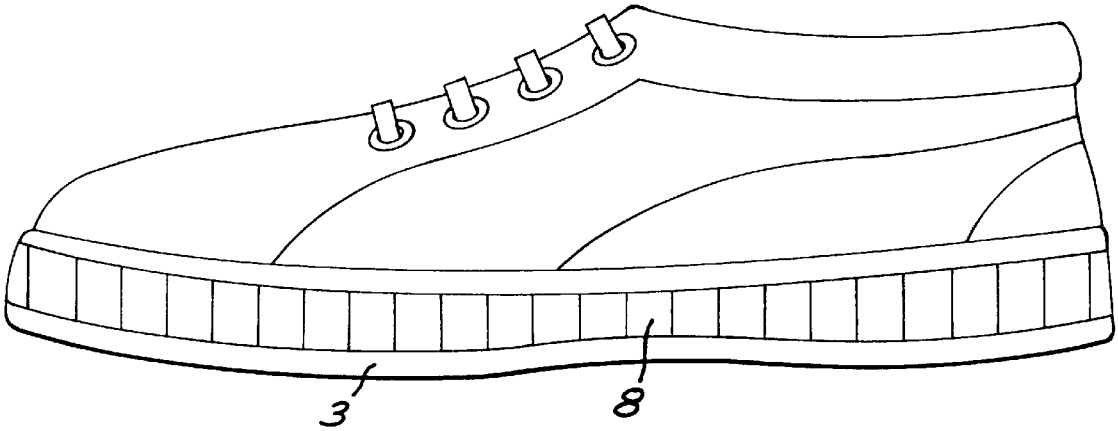
FIG. 10 is a medical side view of an alternative embodiment of the grinding shoe of the present invention incorporating sliding elements on the medical portion of the sole of the shoe.
Figure 10A:
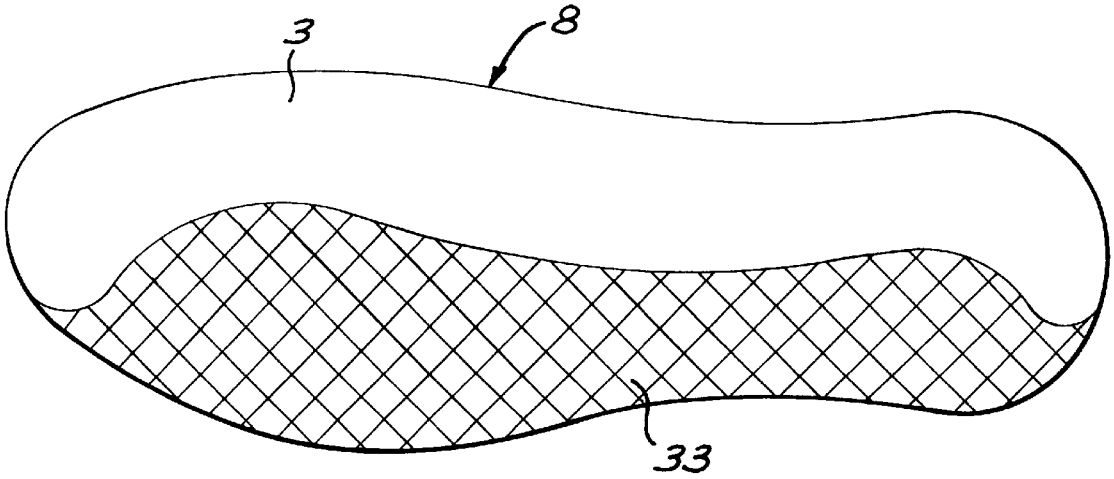
FIG. 10A is a bottom view of the grinding shoe illustrated in FIG. 10.
Figure 11:
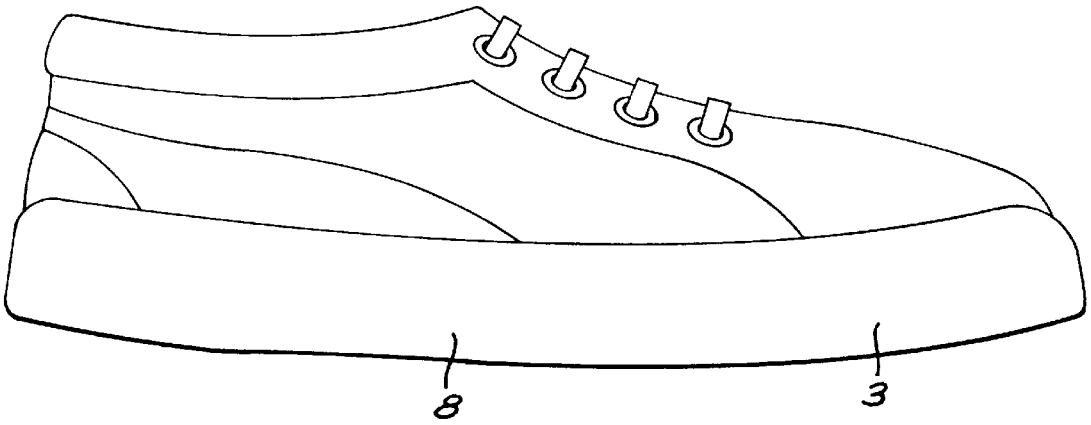
FIG. 11 is a medical side view of another embodiment of a left grinding shoe of the present invention similar to that shown in FIG. 9 showing incorporating a narrow longitudinal sliding element on the lateral portion of the sole and wraps up onto a portion of the lateral edge of the sole.
Figure 11A:
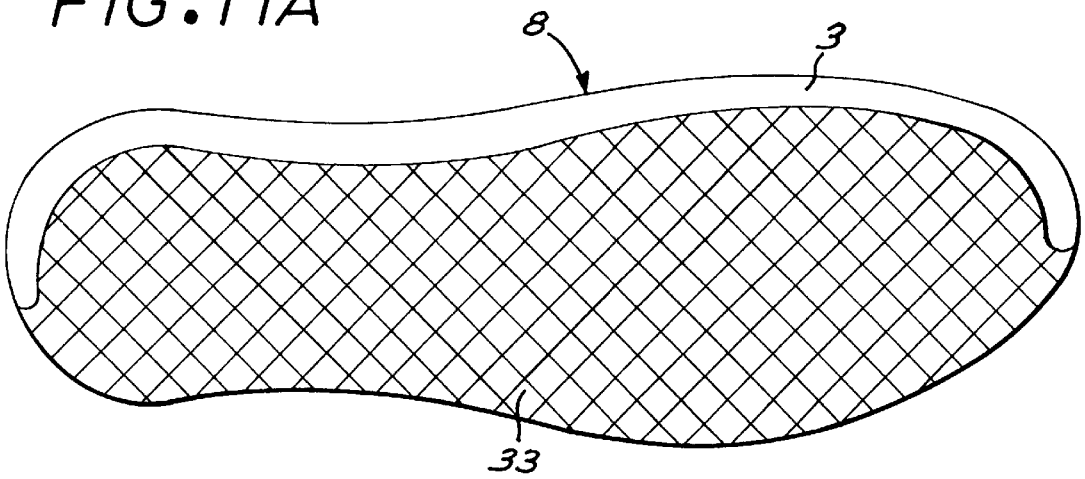
FIG. 11A is a bottom view of the grinding shoe depicted in FIG. 11.

As with other sliding elements of the invention, a sliding element housed, mounted, or otherwise attached to a sole, e.g., to the arch region, can have many shapes and surface contours. For instance, FIG. 7 depicts a transverse sliding element substantially spanning from the lateral to medial edge in the arch region which, when viewed in profile, has a arcuate surface contour that is concave in relation to the ground. Such a surface contour is particularly preferred for transverse, longitudinal, diagonal, and other sliding elements housed in the underside of the sole. In a particularly preferred embodiment, a transverse sliding element spanning from the lateral edge (7) to the medial edge (8) of the arch region (5), in addition to having a convex surface contour when viewed in profile, has a convex surface contour when viewed in frontal cross section. The convex contour provides for easier rotation of the foot about the longitudinal axis (9), whereas the concave contour provides added stability and facilitates balance when grinding on the sliding element. While the convex and concave surface contours have been described in detail, particularly as such relate to transverse sliding elements in the arch region, many other surface contours (when viewed in profile or frontal cross section as, for instance, shown in FIGS. 7A–7D) can be incorporated into a sliding element.

Another embodiment of the invention concerns incorporation of one or more sliding elements in the forefoot region (6). In this region, numerous sliding element configurations are possible, including those wherein a sliding element substantially spans from the toe area (36) of the forefoot region to the arch region along the longitudinal axis (9). Similarly, other sliding elements oriented in the same direction but proximate to the lateral edge (7) and/or (8) medial edge can be incorporated. Alternatively, transverse sliding elements can be housed within the sole in the forefoot region. For example, a transverse sliding element substantially spanning from the lateral edge (7) to the medial edge (8) in the area underling the ball of the foot (35) can be incorporated in the sole. See FIGS. 17 and 17A.

In addition to sliding elements housed in recesses exposed to the underside of the sole, sliding elements may also be incorporated in the toe edge (37), the heel edge (32), the lateral edge (7), and/or the medial edge (8). The toe edge (37) incorporates the toe point (10) and part or all of the lateral and medial edges in the forefoot region (6). Likewise, the heel edge (32) incorporates the heel point (11) and part or all of the lateral and medial edges in the heel region (4). As with other sliding elements according to the invention, sliding elements intended for incorporation in or attachment to an edge of the article of footwear generally do not protrude below the ground contact surface (and preferably terminate somewhat above the ground contact surface), thereby reducing wear to the sliding element and maximizing traction of that portion of the ground contact surface during walking or running. Additionally, such sliding elements may occupy only a part of the corresponding toe, heel, lateral, or medial edge. Indeed, sliding elements for incorporation into these edges are preferably designed only to protect is grinding.

Figure 12:
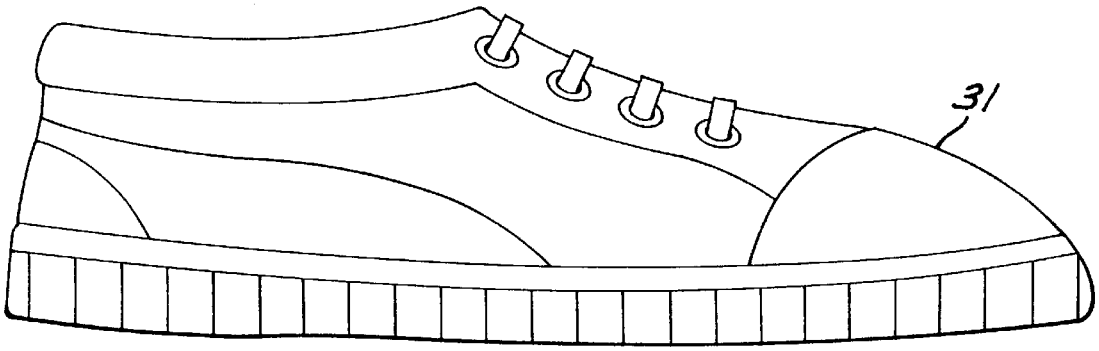
FIG. 12 is a lateral side view of an alternative embodiment of the grinding shoe of the present invention incorporating a sliding element on the upper in ther toe region.
Figure 12A:
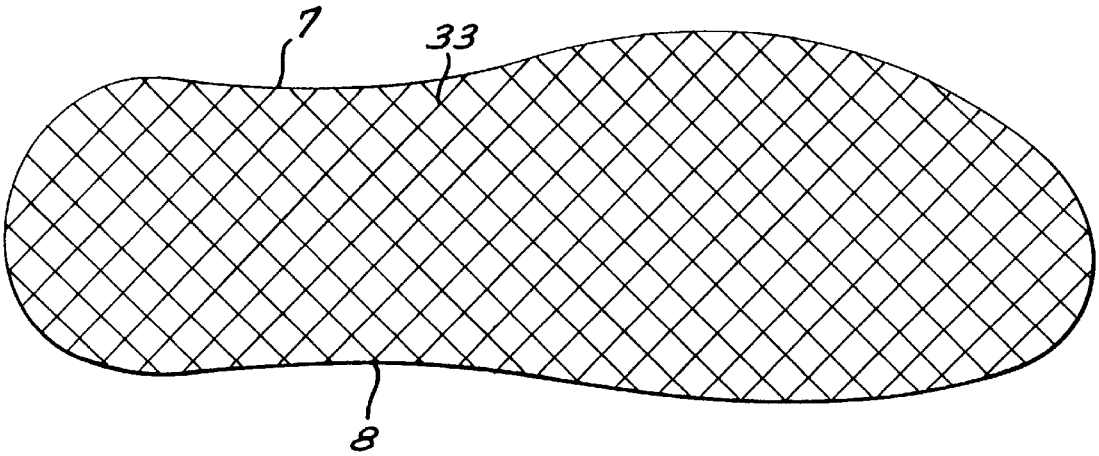
FIG. 12A is a bottom view of the grinding shoe shown in FIG. 12.
Figure 13:
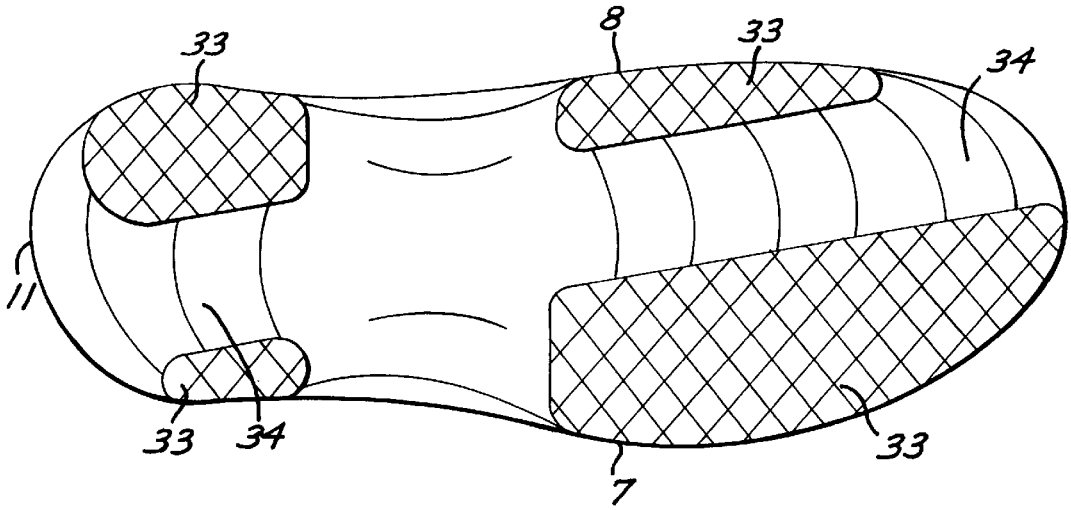
FIG. 13 is a bottom view of another embodiment of the grinding shoe of the present invention showing a transverse sliding element intersected by a longitudinally skewed sliding element.

In an additional embodiment of the invention, a grind plate or sliding element is incorporated into the toe cap (31) of the article of footwear, preferably a shoe or a boot. See FIG. 12. Such a sliding element facilitates grinding maneuvers wherein the wearer rotates the article of footwear forward on the toe, such as in a lunge, where the sole of the article of footwear on the trailing foot may be rotated past vertical.

In addition to the foregoing embodiments, additional sliding elements may be attached to the upper (38) of the article of footwear, such as to one or both sides, the tongue, or to top of the toe region. In such embodiments, the sliding elements will protect the upper from contact and abrasion in the event that part of the article is brought into contact with the grinding surface, as well as provide for additional grinding areas to expand the range of potential grinding maneuvers.

Figure 22:
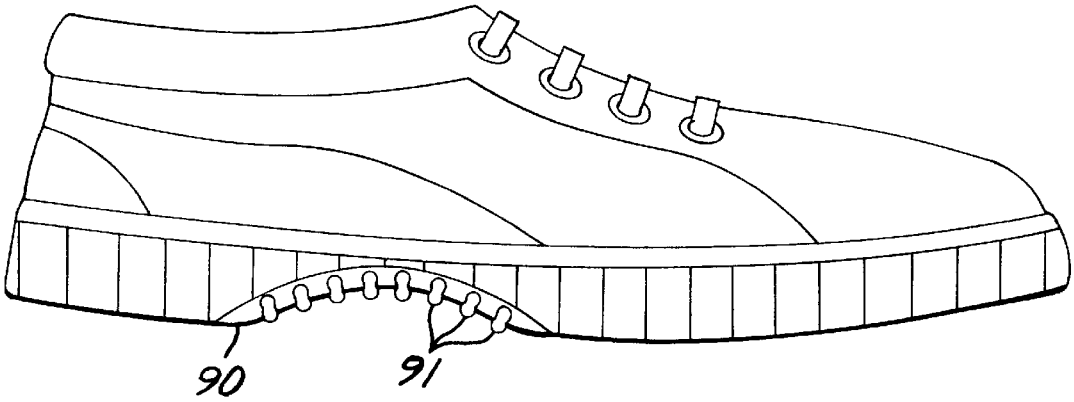
FIG. 22 is a lateral side view of an alternative embodiment of the grinding shoe of the present invention incorporating mulitple sliding elements retained within grooves of a grind plate.
Figure 22A:
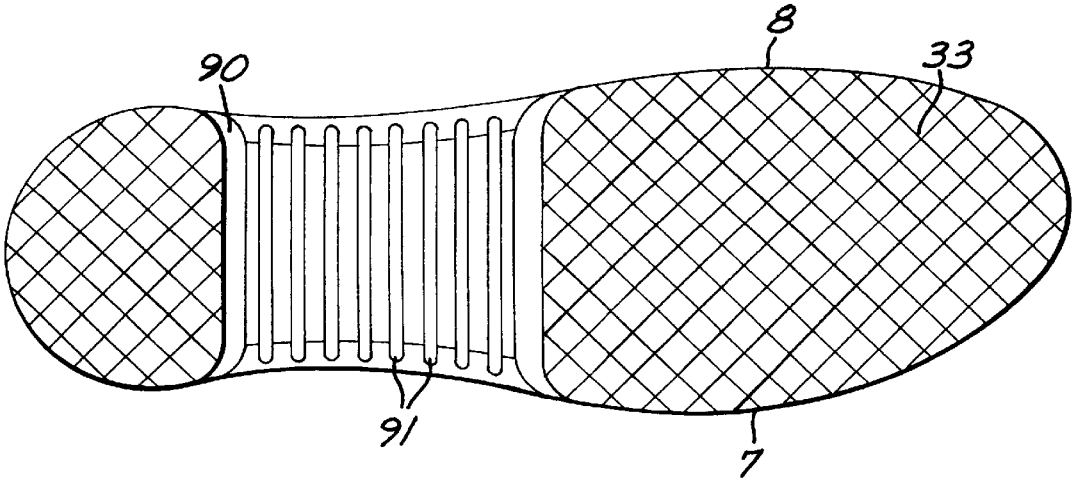
FIG. 22A is a bottom view of the grinding shoe shown in FIG. 22.
Figure 23:
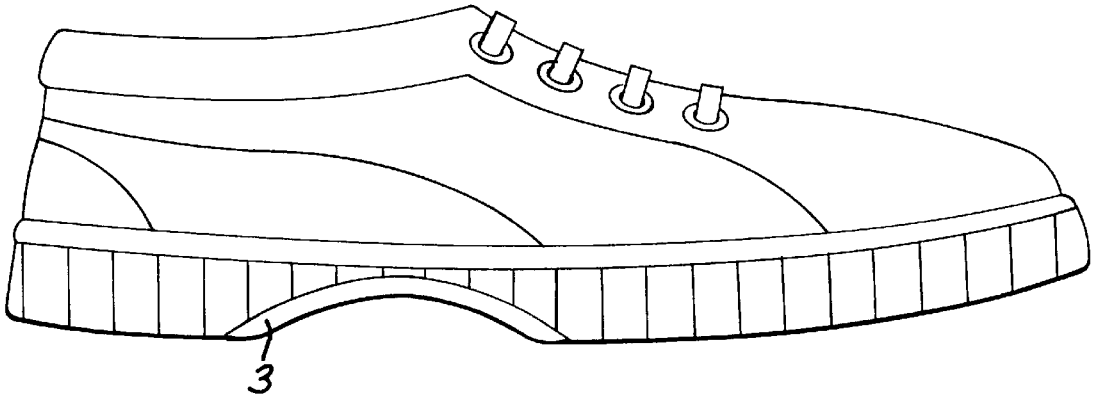
FIG. 23 is a lateral side view of another embodiment of the grinding shoe of the present invention illustrating an anteriorly disposed fastener.
Figure 23A:
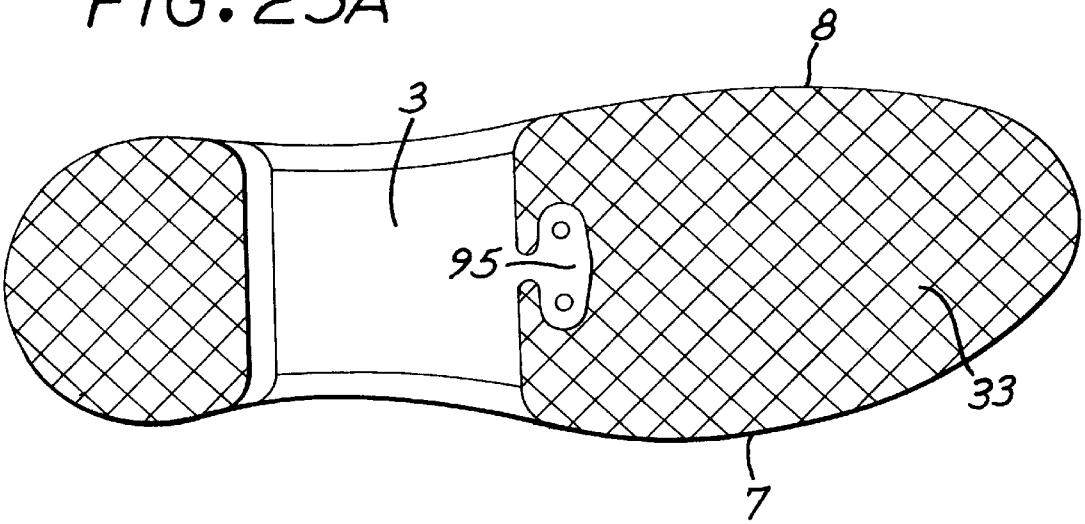
FIG. 23A is a bottom view of the grinding shoe shown in FIG. 23.
Figure 24:
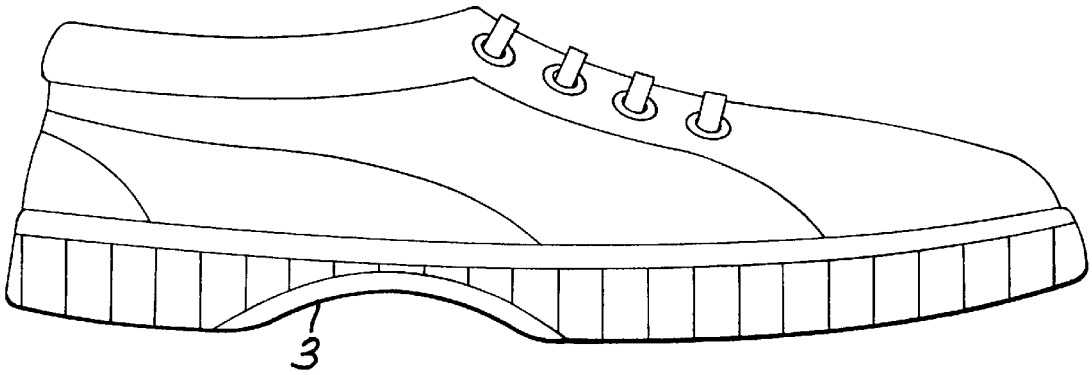
FIG. 24 is a view similar to FIG. 23 with the addition of a posteriorly disposed fastener.
Figure 24A:
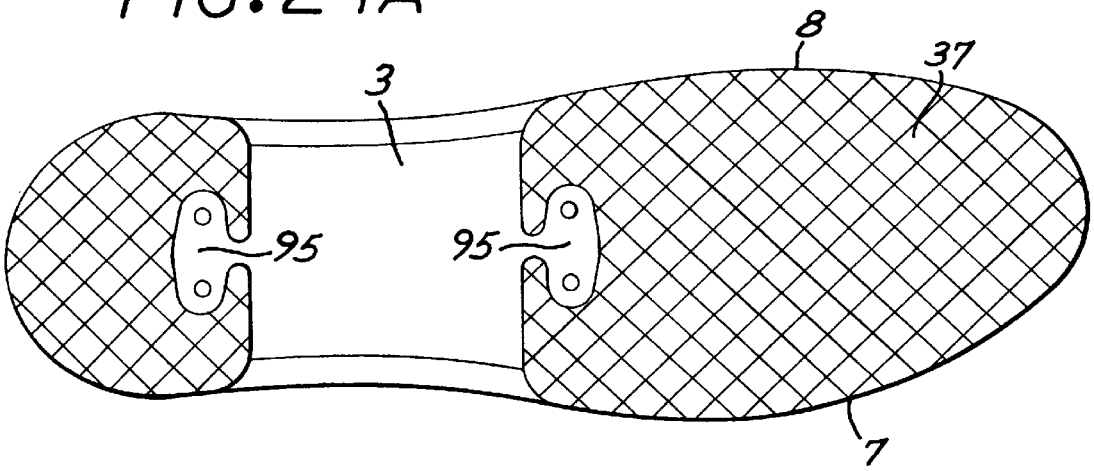
FIG. 24A is a bottom view of the grinding shoe shown in FIG. 24.
Figure 25:
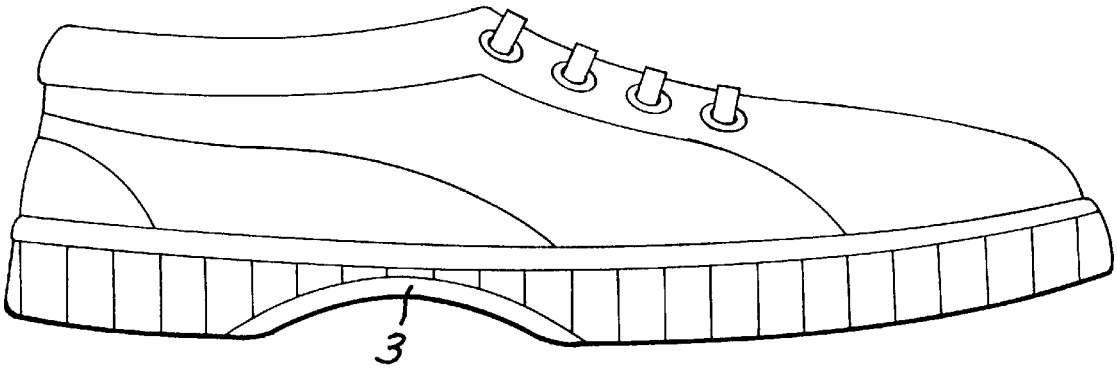
FIG. 25 is a view similar to that shown in FIG. 23 showing a posteriorly disposed fastener.
Figure 25A:
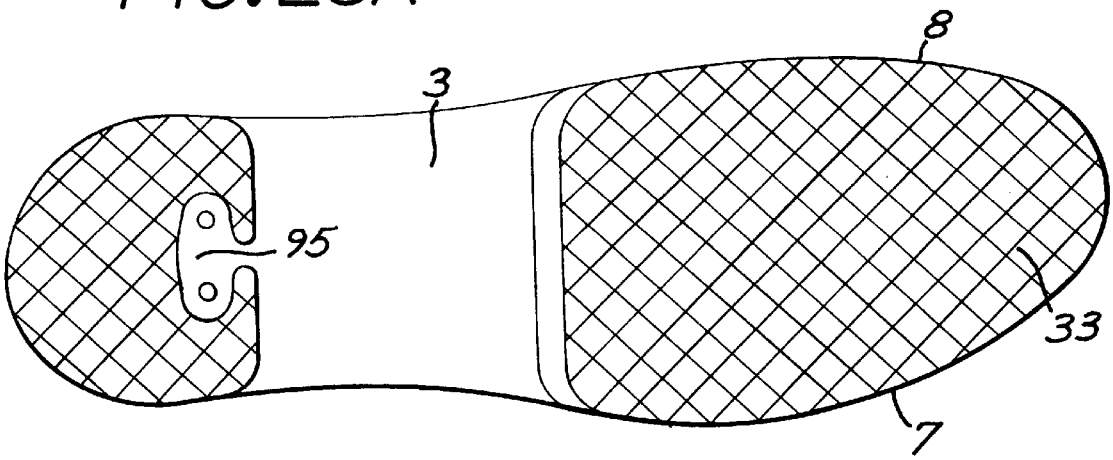
FIG. 25A is a bottom view of the view of the grinding shoe shown in FIG. 25.

Sliding elements according to the invention can be attached to an article of footwear in many ways, as will be appreciated by those in the art. Such attachment is preferably made by housing or mounting a sliding element in a corresponding recess or other attachment point on the sole of the article, although this is not essential. Sliding elements may be retained in their desired locations by mechanical methods, such as compression fitting or by other structures which prevent the sliding element from disassociation from the article of footwear. For example, FIGS. 22 and 22A shows a transverse multi-component sliding element (90) wherein each component (91) spans substantially from the lateral edge to the medial edge of the shoe in the arch region and has an hour glass profile. Similarly, FIGS. 23–25A show a transverse sliding element (3) which comprises one or more ovular male portions (95) which are fittingly associated with a complementary female recess in the region of the forefoot and/or heel proximal to the arch region. In preferred embodiments, such configurations serve to minimize or eliminate separation of the sliding element (3) from the sole. As those in the art will appreciate, the particular materials and configurations are within the skill in the art and will depend on many factors, including intended application.

Figure 19:
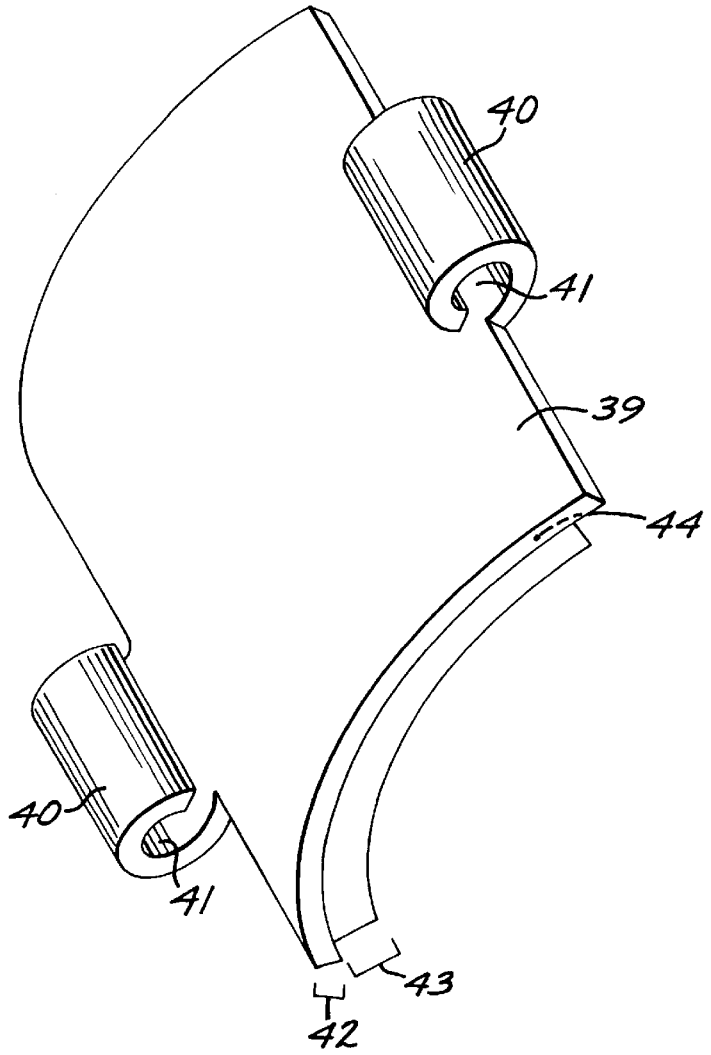
FIG. 19 is a perspective view of another embodiment of the plate of the present invention.
Figure 20:
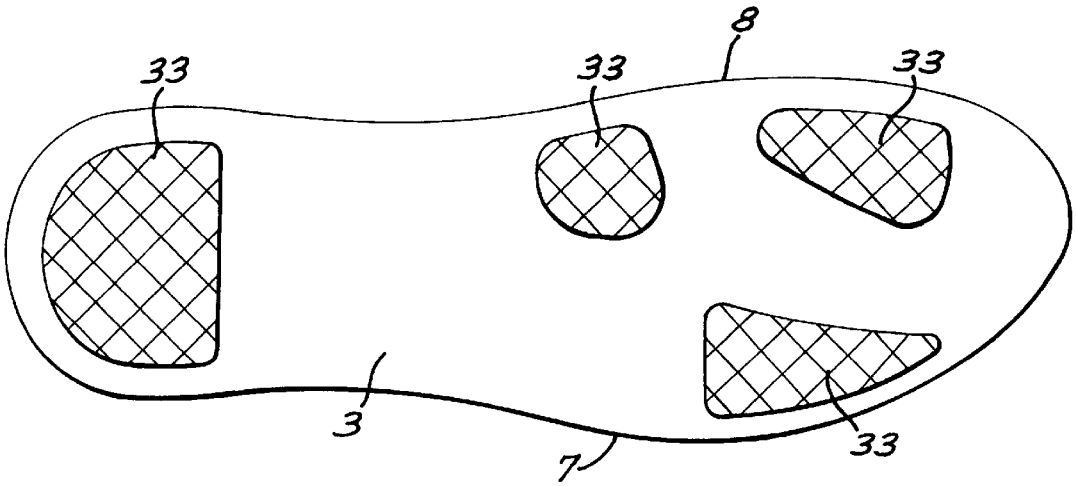
FIG. 20 is a bottom view of the grinding shoe of the present invention depicting a ground contact surface having a reduced area.

Alternatively, various fasteners may be used to attach the sliding elements. For example, FIG. 19 shows a rectangular backing plate (39) forming an upper mount 42 with an arcuate, concave profile configured for attachment to an article of footwear in the arch region. The backing plate incorporates two oppositely disposed slotted cylinders (40), each having a bore (41) and being attached to the upper portion (42). The lower grind plate (43) of the grind plate assembly is concentric with the upper portion (42) but is slightly shorter along each edge, which allows it to be positioned in the sole (or pre-positioned in the event the sole is cast around it) in a preformed recess or window in the arch region. The window preferably contains a seat upon which the bearing face (44) of the upper portion rests after positioning. The sole will also contain recesses complementary to the outer dimensions of the cylinders (40), and channels designed to be concentric with each bore, wherein each channel extends from the lateral edge or medial edge (two from each edge in this instance) to the cylinder recess. After positioning the grind plate, a bolt or pin may be inserted through the channels and bores (41) from the lateral and/or medial edge, and a nut or other retainer attached to the ends opposite of the heads thereof in order to secure the grind plate (39).

Alternatively, or in addition to mechanical methods or the use of fasteners to attach or retain sliding elements, other techniques may also be used. As previously described, sliding elements can be pre-positioned in molds used for manufacturing soles, after which the material(s) comprising the sole (or outsole, as the case may be) is (are) added to the mold. Other methods involve the use of chemical bonding agents, including glues and epoxies, to attach sliding elements to articles of footwear. Other methods, techniques, or compounds are also contemplated in the practice of this invention.

As is apparent from the foregoing, certain embodiments of the invention relate to articles of footwear containing sliding elements which can be removed for repair or replacement, and thus are within the scope of the invention.

Figure 21:
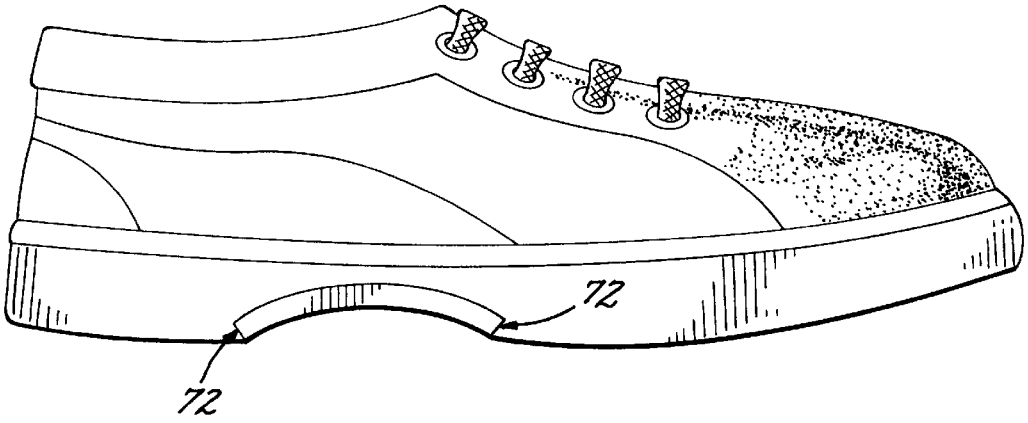
FIG. 21 is a lateral side view of an alternative embodiment of the grinding shoe of the present invention illustrating a sliding element that can be released from the sole through flexure of the shoe.
Figure 21A:
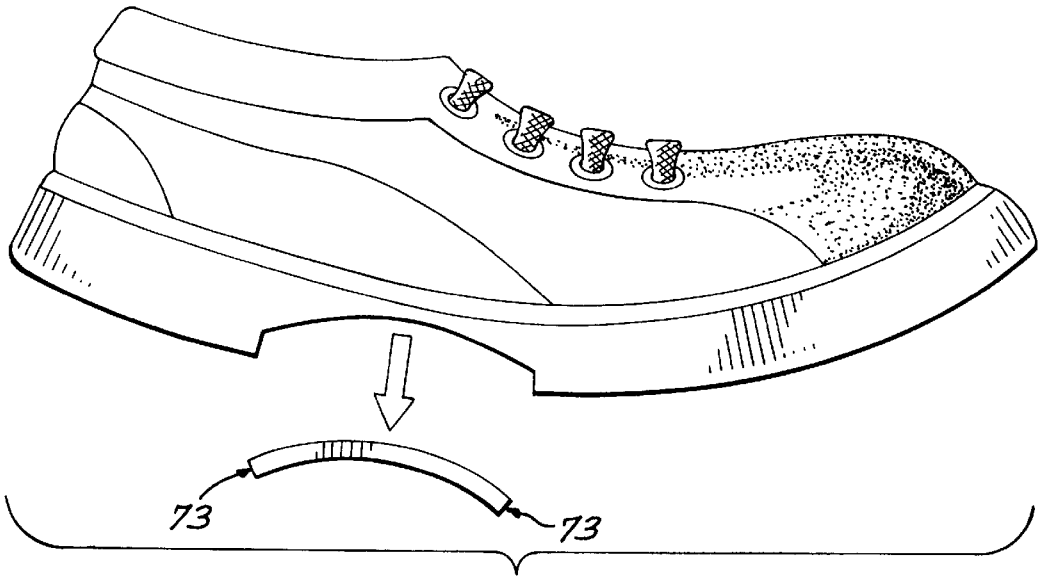
FIG. 21A is an exploded view of FIG. 21 showing the grinding shoe in a state of flex.

A preferred embodiment of a "quick-release" transverse sliding element is depicted in FIGS. 21 and 21A. There, the sliding element is retained by a mechanical lock under normal conditions. As depicted in FIGS. 21 and 21A, the lock comprises a V-shape when viewed in profile, wherein the recess in the sole comprises opposed tapered edges (72) which present the sliding element (having tapered edges (73) complementary to those of the recess) from falling out under normal conditions. As those in the art will appreciate, the taper angle and depth of the recess required to retain the sliding element during normal use and during grinding activities will depend on many factors, including the rigidity of the sole and thickness of the sliding element. The sliding element may be released by applying sufficient upward force to the heel and forefoot regions and a downward force to the arch region such that the sole flexes sufficiently so as to allow the tapered edges of the sliding element to become disengaged from their complementary edges in the recess in the sole. In this way, the sliding element can be quickly removed. The amount of flexion required to release the sliding element will be sufficiently greater than that which can occur when attached to a foot to ensure that the sliding element is not unintentionally released. As those in the art will appreciate, additional mechanisms known in the art can be employed in such a configuration to prevent lateral slippage of the sliding element.

While the present invention has been described above both generally and in terms of preferred embodiments, it is understood that variations and modifications will occur to those skilled in the art in light of the description, supra. Therefore, it is intended that the appended claims cover all such variations coming within the scope of the invention as claimed.

It is further understood that, as used herein, the terms "including," "e.g." and the like are not exclusive, but instead mean "including, but not limited to" or "including, without limitation."In addition, all references referred to herein are incorporated by reference in their entirety.

I claim:

1. Grind plate assembly for mounting to a high coefficient of friction sole of a shoe to grind over an elongated rail or the like, including:

a backing plate to be embedded in said sole and including a first fastener element; and a grind plate device to be carried from said backing plate and having a low coefficient of friction grind element formed with a downwardly facing grind surface for engaging and sliding along said rail and including a second fastener element to be aligned with said first fastener element.

2. Grind plate assembly as set forth in claim 1 wherein:

said grind element is constructed with laterally disposed grind surfaces facing downwardly and inwardly to contact the opposite sides of said rail.

3. Grind plate assembly as set forth in claim 1 wherein:

said grind plate device is curved to form a raised linear axis.

4. Grind plate assembly as set forth in claim 1 wherein:

said grind surface formed with a trough having a linear apex to be, when said fastening elements are aligned, centered under said shoe.

5. Grind shoe apparatus comprising:

a shoe including a sole having a downwardly facing plate mounting surface;

a plate device mounted with its top side engaging said mounting surface and including a grind element having a downwardly facing exposed grind surface, said grind element being moveable relative to said shoe.

6. Grind shoe apparatus according to claim 5 wherein:

said moveable element is constructed to be rotatable relative to said shoe.

7. Grind shoe apparatus according to claim 5 wherein:

said plate device includes a plurality of said grind elements.

8. Grind shoe apparatus according to claim 5 wherein:

said plate includes a bore and said grind element is received in said bore.

9. Grind shoe apparatus according to claim 5 wherein:

said plate includes a plurality of said bores and a plurality of grind elements, one received in each of said bores.

10. Grind shoe apparatus according to claim 6 wherein:

selected ones of said grind elements are constructed to have a coefficient of friction different from other of said elements.

11. Shoe apparatus for translation along a rail and comprising:

a shoe including a sole formed with a downwardly facing high coefficient or friction surface configured centrally with a downwardly opening recess of a predetermined shape and including shoe fastener bores;

a plate configured to be complementally received in said recess, including a plurality of downwardly opening cavities spaced thereabout and formed with fastener bores aligned with said shoe fastener bores; and low friction elements in said downwardly opening cavities and projecting downwardly from said plate to engage said rail.

12. Shoe apparatus according to claim 11 wherein:

said low friction elements arc rotatable in said cavities.

13. Shoe apparatus according to claim 11 wherein:

said low friction elements are formed with a round cross-section.

14. Shoe apparatus according to claim 11 wherein:

said low friction elements project laterally across the bottom of said plate.

15. Shoe apparatus according to claim 11 wherein:

said low friction elements are cylindrical.

16. Shoe apparatus according to claim 11 wherein:

said cavities are cylindrical in cross-section.

17. Shoe apparatus according to claim 16 wherein:

said low friction elements are cylindrical in cross-section and configured to complement the shape of said cavities.

18. A shoe grind plate including:

a saddle shaped plate body raised centrally to form a laterally projecting, downwardly facing trough; and a plurality of low friction elements mounted in said trough and projecting downwardly from said plate body to define respective downwardly facing support surfaces.

19. A shoe grind plate as set forth in claim 18 wherein:

said plate body is formed on its bottom side with a plurality of downwardly opening cavities; and said low friction elements are mounted in said cavities.

20. A shoe grind plate as set forth in claim 19 wherein:

said cavities and low friction elements cooperate to rotatably mount said low friction elements for rotation in said plate body.

21. A shoe grind plate as set forth in claim 19 wherein:

said low friction elements are cylindrical and said cavities arc constructed to mount said elements for rotation about their own respective axes.

22. Shoe apparatus for translation along a rail and comprising:

a shoe including a sole formed with a downwardly facing high coefficient of friction surface configured centrally with a downwardly opening recess of a predetermined shape and including shoe fastener bores;

a rigid plate including a plate body formed with fastener bores, configured to be complementally received in said recess, and having at least one load bearing element formed with a downwardly facing load bearing surface having a low coefficient of friction for engaging and translating along said rail.

23. Shoe apparatus according to claim 22 wherein:

said plate body is formed with a downwardly facing body surface; and said load by element is formed with said load bearing surface spaced below said body surface.

24. Shoe apparatus according to claim 22 that includes:

a plurality of load bearing elements.

25. Shoe apparatus according to claim 22 wherein:

said load bearing element projects laterally across the bottom of said plate.

26. Shoe apparatus according to claim 22 wherein:

said plate body is saddle shaped.

27. Shoe apparatus according to claim 22 wherein:

said plate body includes rails along the opposite lateral sides thereof forming downwardly facing slide surfaces.

28. Shoe apparatus according to claim 24 wherein:

said load bearing elements are cylindrically shaped in cross-section and configured to complement the shape of said cavities.

* * * * *

UNITED STATES PATENT AND TRADEMARK OFFICE

CERTIFICATE OF CORRECTION

PATENT NO. : 5,970,631
DATED : October 26, 1999
INVENTOR(S) : David G. Inman

It is certified that error appears in the above-identified patent and that said Letters Patent is hereby corrected as shown below:

Column 4, line 23, delete "medical" and insert --medial--;

line 56, delete "form" and insert --from--;

Column 5, line 24, delete "the view of";

Column 7, line 37, delete "or outsole) and insert --(or outsole)--;

Column 11, line 17, after "and" insert --flat ground, and thereby does not affect the traction or adhesion of--;

Column 11, line 50, after "that" insert --the longitudinal sliding element (34) spans from the toe region of the --;

Column 12, line 56, after "protect" insert --those edge areas which may contact grinding surfaces while the wearer--.

Signed and Sealed this
Thirtieth Day of May, 2000

*Attest:*

*Attesting Officer*

Q. TODD DICKINSON

*Director of Patents and Trademarks*